US005781204A

United States Patent [19]

Kanematsu et al.

[11] Patent Number: 5,781,204

[45] Date of Patent: Jul. 14, 1998

[54] INK JET APPARATUS WITH SUCTION RECOVERY CONTROLLED ACCORDING TO HEAD TEMPERATURE AND INK DISCHARGE FREQUENCY

[75] Inventors: Daigoro Kanematsu; Naoji Otsuka; Kentaro Yano, all of Yokohama; Kiichiro Takahashi; Osamu Iwasaki, both of Kawasaki, all of Japan

[73] Assignee: Canon Kabushiki Kaisha, Tokyo, Japan

[21] Appl. No.: 508,677

[22] Filed: Jul. 28, 1995

[30] Foreign Application Priority Data

Jul. 29, 1994 [JP] Japan ..... 6-179065

[51] Int. Cl.[6] ..... B41J 29/38; B41J 2/165

[52] U.S. Cl. ..... 347/17; 347/23; 347/30

[58] Field of Search ..... 347/17, 23, 14, 347/30, 12

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,353,051 | 10/1994 | Katayama et al. | 347/13 |
| 5,367,325 | 11/1994 | Yano et al. | 347/17 |
| 5,519,418 | 5/1996 | Nishikawa et al. | 347/23 |
| 5,572,242 | 11/1996 | Fujii et al. | 347/23 |
| 5,576,745 | 11/1996 | Matsubara | 347/19 |

FOREIGN PATENT DOCUMENTS

| | | | |
|---|---|---|---|
| 59-123670 | 7/1984 | Japan | B41J 3/04 |
| 59-138461 | 8/1984 | Japan | B41J 3/04 |
| 4-93260 | 3/1992 | Japan | B41J 2/18 |

*Primary Examiner*—Benjamin R. Fuller
*Assistant Examiner*—Thien Tran
*Attorney, Agent, or Firm*—Fitzpatrick, Cella, Harper & Scinto

[57] ABSTRACT

An ink jet apparatus is described which includes a suction recovery device and control thereof so as to appropriately remove air bubbles created in an ink jet head. The ink jet apparatus is characterized in that at each unit time, the ambient temperature of the ink jet head is measured and the temperature of the ink jet head is presumed, and the number of dots discharged for a unit time is corrected on the basis of the measured ambient temperature and the temperature of the ink jet head obtained by the presumption, and the control of the recovery operation is effected in conformity with the corrected number of dots.

37 Claims, 19 Drawing Sheets

INK JET APPARATUS WITH SUCTION RECOVERY CONTROLLED ACCORDING TO HEAD TEMPERATURE AND INK DISCHARGE FREQUENCY

BACKGROUND OF THE INVENTION

1. Field of the Invention

This invention relates to an ink jet apparatus designed to suck and discharge ink periodically from an ink path, an ink chamber and an ink supply path in order to secure the quality of print.

2. Related Background Art

Various recording apparatus such as a printer, a copying apparatus and a facsimile apparatus are designed to print characters and images comprising dot patterns on a material to be printed such as paper or a plastic sheet on the basis of character information and image information.

These recording apparatus can be grouped into an ink jet type, a wire dot type, a thermal type, a laser beam type, etc. by their recording types.

Among them, the ink jet type is to discharge ink from an ink jet head to a printing medium to thereby effect printing, and has the advantages that highly minute images can be printed at a high speed and that because of being a non-impact type, noise is little and moreover it is easy to print color images by the use of inks of multiple colors.

However, in an ink jet apparatus of the type which effects printing by an ink jet head discharging ink, air bubbles are liable to stagnate in an ink path along which the ink flows, the connecting portion between the ink path and an ink chamber for supplying the ink to the ink path, or the connecting portion between the ink chamber and an ink supply path, and this leads to the occurrence of a case where the discharge of the ink becomes impossible or the ink becomes absent near discharging means in the ink path normal printing becomes impossible.

So, in the ink jet apparatus according to the prior art, provision is made of a head cap covering the whole of the discharge port surface of the ink jet head and further, suction recovery control means for sucking the ink and air bubbles in the ink path, the ink chamber and the ink supply path through the head cap is incorporated so that the ink may be sucked by the suction pump of the suction recovery control means after the ink jet head is capped at a position whereby the head cap and the ink jet head are opposed to each other. The suction operation by this suction recovery control means is an important technique for enhancing the reliability of the ink jet apparatus.

Now, even if such a suction condition that an optimum air bubble removing performance is displayed is determined, the volumes of the air bubbles in different suction operation periods are actually various and therefore, similar air bubble removing performances are not always displayed.

So, in the ink jet apparatus according to the prior art, in order to maintain a good air bubble removing capability, design is made such that as proposed, for example, in Japanese Laid-Open Patent Application No. 4-93260, etc., the next suction process operation period is determined by the frequency of ink discharge and the time count of the time for which the apparatus is left unused or the next suction process operation period is determined by the frequency of ink discharge, the time count of the time for which the apparatus is left unused and the temperature of the ink jet head so that suction may be effected as much as possible in the state of a constant air bubble volume.

In the case of the suction recovery control means in the ink jet apparatus according to the prior art, no consideration has been paid to the point that the amount of bubbles created in the ink path differs depending on the difference in the amount of ink discharge.

Consideration has neither been paid to the speed of growth of air bubbles during printing by the difference between the ambient temperature of the ink jet head and the temperature in the ink path or the ink chamber. Moreover, the speed of growth of air bubbles during printing and the amount of creation of left bubbles by the ambient temperature have not been linked together.

That is, there has been the inconvenience that even when it is unnecessary to effect suction recovery, the recovery operation is performed to thereby cause a reduction in throughput or an increase in the amount of discharge ink or conversely the suction interval is made too long to thereby cause bad printing.

SUMMARY OF THE INVENTION

It is an object of the present invention to provide an ink jet apparatus in which the amount of air bubbles created in an ink jet head is estimated more accurately than in the prior art and the frequency of ink suction is minimized and which is high in reliability without the throughput of the apparatus being reduced.

It is another object of the present invention to provide an ink jet apparatus in which the suction recovery operation is performed immediately before unsatisfactory ink discharge occurs, whereby the reliability of the apparatus is enhanced and the running cost of the apparatus is reduced.

The present invention has been made in order to achieve the above objects and provides an ink jet apparatus having an ink jet head for discharging ink from a discharge port, and suction recovery means for sucking the ink from said discharge port to thereby recover the discharge state of the ink, characterized by the provision of temperature detecting means for detecting the ambient temperature of said ink jet head, temperature calculating means for calculating the temperature of said ink jet head, count means for counting the frequency of discharge of the ink from said ink jet head, and suction recovery control means for determining the recovery operation of said suction recovery means on the basis of the temperatures obtained by said temperature detecting means and said temperature calculating means and the frequency of discharge obtained by said count means.

Said suction recovery control means corrects the frequency of discharge obtained by said count means, on the basis of the temperature obtained by said temperature detecting means and the temperature obtained by said temperature calculating means, and determines whether the recovery operation of said suction recovery means is to be performed in conformity with the corrected frequency of discharge.

A second form of the present invention is characterized in that said ink jet head is divided into a plurality of blocks each comprising a plurality of discharge ports and said count means effects a frequency of discharge of the ink for each block and said suction recovery control means determines the recovery operation of said suction recovery means on the basis of the temperatures obtained by said temperature detecting means and said temperature calculating means and the frequency of discharge for each block obtained by said count means.

As another example of the second form, provision is made of non-print time count means for counting, by said count means, the non-print time for which discharge has not been effected by the plurality of discharge ports corresponding to said plurality of blocks, said suction recovery control means corrects the frequency of discharge obtained by said count means, on the basis of the temperature obtained by said temperature detecting means and the temperature obtained by said temperature calculating means, and whether the recovery operation of said suction recovery means is to be performed is determined by whether the corrected frequency of discharge reaches a predetermined value or whether the value obtained by correcting the non-print time obtained by said nonprint time count means, on the basis of the temperature obtained by said temperature detecting means and the temperature obtained by said temperature calculating means reaches a predetermined value, whereby more appropriate control of suction recovery is achieved.

A third form of the present invention is an ink jet apparatus having an ink jet head for discharging ink from a discharge port by a drive pulse being applied to discharge means, and suction recovery means for sucking the ink from said discharge port to thereby recover the discharge state of the ink, characterized by the provision of discharge amount control means for controlling the amount of ink discharged from said discharge port by the modulation of said drive pulse, temperature detecting means for detecting the ambient temperature of said ink jet head, temperature calculating means for calculating the temperature of said ink jet head, count means for counting the frequency of discharge of the ink from said ink jet head, and suction recovery control means for determining the recovery operation of said suction recovery means on the basis of the temperatures obtained by said temperature detecting means and said temperature calculating means, the frequency of discharge obtained by said count means, and the amount of ink discharged under the control of said discharge amount control means.

Also, the suction recovery control means in the third form corrects the frequency of discharge obtained by said count means, on the basis of the temperature obtained by said temperature detecting means, the temperature obtained by said temperature calculating means and the drive pulse applied to said discharge means, and determines whether the recovery operation of said suction recovery means is to be performed in conformity with the corrected frequency of discharge, whereby more appropriate control of suction recovery can be achieved.

A fourth form of the present invention is a recovery controlling method in an ink jet apparatus having an ink jet head for discharging ink from a discharge port, and suction recovery means for sucking the ink from said discharge port to thereby recover the discharge state of the ink, characterized in that a process comprising the temperature detecting step of detecting the ambient temperature of said ink jet head, the temperature calculating step of calculating the temperature of said ink jet head, and the counting step of counting the frequency of discharge of the ink from said ink jet head within a first predetermined time is carried out for each predetermined unit time, and at the predetermined timing of a time interval longer than said predetermined unit time, the recovery operation of said suction recovery means is determined on the basis of the temperatures obtained by said temperature detecting step and said temperature calculating step, and the frequency of discharge obtained by said counting step.

As regards the determination of the recovery operation of the suction recovery means in the fourth form, the frequency of discharge obtained by said counting step is corrected on the basis of the temperature obtained by said temperature detecting step and the temperature obtained by said temperature calculating step, and whether the recovery operation of said suction recovery means is to be performed is determined in conformity with the corrected frequency of discharge, whereby more appropriate control of recovery is achieved.

BRIEF DESCRIPTION OF THE DRAWINGS

FIG. 3 is a perspective view in which the interior of the ink jet printer in the present embodiment is seen through.

DESCRIPTION OF THE PREFERRED EMBODIMENTS

An embodiment in which an ink jet apparatus according to the present invention is applied to an ink jet printer will hereinafter be described in detail with reference to FIGS. 1 to 22.

Figure 1:
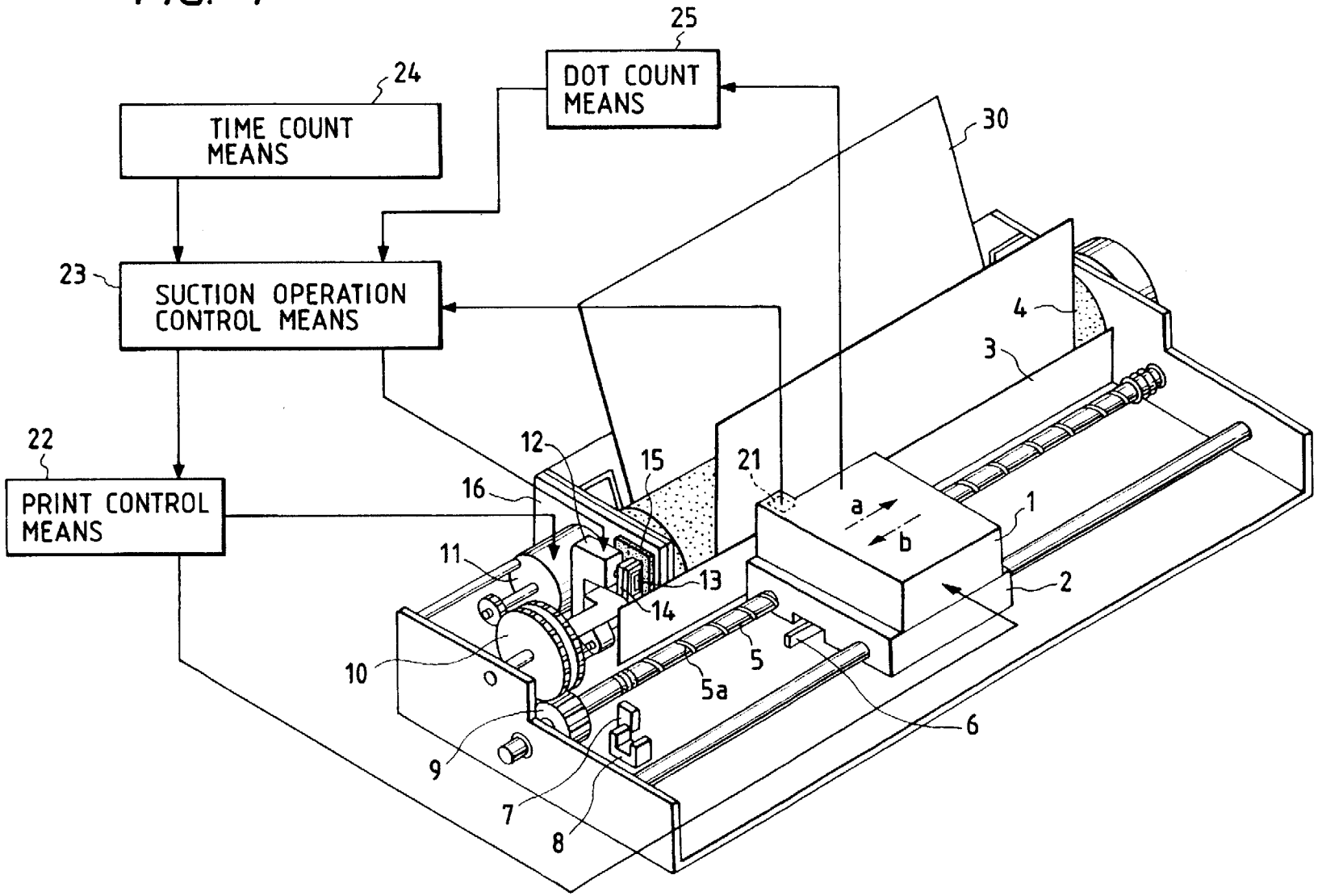
FIG. 1 is a perspective view schematically showing the structure of the essential portions of an embodiment in which an ink jet apparatus according to the present invention is applied to a printer.

The external appearance of the essential portions of the ink jet printer in the present embodiment is shown in FIG. 1. In FIG. 1, the forward and reverse rotation of a drive motor 11 may be transmitted to a feed screw 5 through two drive force transmitting gears 9 and 10, whereby a carriage 2 may be reciprocally moved in the directions of arrows a and b. On the carriage 2, there is carried an ink jet cartridge 1 in which an ink tank, not shown, containing ink for printing therein and an ink jet head 18 (see FIG. 2) for discharging the ink toward recording paper 30 are made integral with each other. Also, a platen 4 for conveying the recording paper 30 is rotatably provided in opposed relationship with the ink jet cartridge 1.

The recording paper 30 conveyed by the rotation of the platen 4 is pressed against the platen 4 by a paper holding-down plate 3 on a side opposed to the ink jet cartridge 1, and is held so that the interval between it and the discharge port surface of the ink jet head 18 may become a predetermined interval. The printing operation of discharging the ink from the ink jet head 18 while moving the carriage 2 by a drive motor 11 is performed on the basis of the control of print control means 22, and the number of print dots at this time is counted by dot count means 25. A temperature sensor 21 for measuring the temperature of the ink jet head 18 of the ink jet cartridge 1 is mounted on the ink jet head 18, and an amount of electricity conforming to the value thereof is outputted to suction operation control means 23.

The temperature sensor 21 need not always be mounted on the ink jet head 18, but it can be mounted at any location in the ink jet apparatus if it is one which can forecast the temperature of the ink jet head 18.

Two photocouplers 7 and 8 are provided on the left side as viewed in the direction of movement of the carriage 2. These photocouplers 7 and 8 are home position detecting means for confirming the presence of a lever 6 provided on the left end portion of the carriage 2 in this area and effecting the changeover or the like of the direction of rotation of the drive motor 11. Also, a cap member 13 supported by a cap supporting member 14 is provided at a location which is outside the range of the reciprocal movement of the ink jet cartridge 1 in the printing operation and to which the ink jet cartridge 1 is moved during the suction operation. The cap member 13 is for capping the whole of the discharge port surface la (see FIG. 2) of the ink jet head 18 of the ink jet cartridge 1, and in this state, suction in the cap member 13 is effected by suction means 12, whereby the head recovery operation of removing viscosity-increased ink and air bubbles in the ink jet head 18 is performed.

A cleaning blade 15 supported by a blade supporting member 16 is provided sideways of the cap member 13. The cleaning blade 15 is supported on the blade supporting member 16 for protrusion toward the ink jet cartridge 1 and is capable of bearing against the front face of the ink jet head 18. Thereby, after the suction operation, the cleaning blade 15 is protruded into the movement path of the ink jet cartridge 1 to thereby wipe off the stain or the like of the front face of the ink jet head 18 with the movement of the ink jet cartridge 1. The cleaning blade 15 is not restricted to this form, but it is also possible to utilize other well-known cleaning blades.

Figure 2:
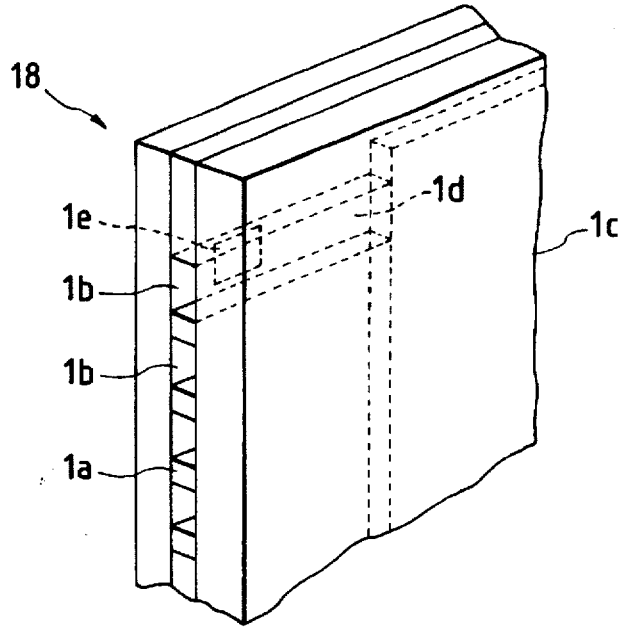
FIG. 2 is a broken-away perspective view in which a portion of an ink jet head in the embodiment shown in FIG. 1 is extracted and enlarged.

As shown in FIG. 2 wherein a portion of the ink jet head 18 in the present embodiment is extracted and enlarged, the ink jet head 18 has a plurality of discharge ports **1*b* formed at a predetermined pitch in the discharge port surface 1*a* thereof opposed to the recording paper 30 (see FIG. 1) with a predetermined interval therebetween, and an electro-thermal conversion element 1*e* for generating energy for ink discharge is disposed along the wall surface of each ink path 1*d* connecting a common ink chamber 1*c* and each discharge port 1*b* together. The common ink chamber 1*c* communicates with the ink tank of the aforedescribed ink jet cartridge 1 (see FIG. 1), and design is made such that the ink is supplied from the ink tank to the common ink chamber 1*c*. The ink supplied to and temporarily stored in the common ink chamber 1*c* from the ink tank keeps its state filling up the paths 1*d* by capillary phenomenon. When at this time, the electro-thermal conversion elements 1*e* are electrically energized through electrodes, not shown, and generate heat, the ink facing the electro-thermal conversion elements 1*e* is suddenly heated and air bubbles are created on the electro-thermal conversion elements 1*e* in the ink paths, and by the expansion of these air bubbles, the ink is discharged from the discharge ports 1*b***.

Figure 3:
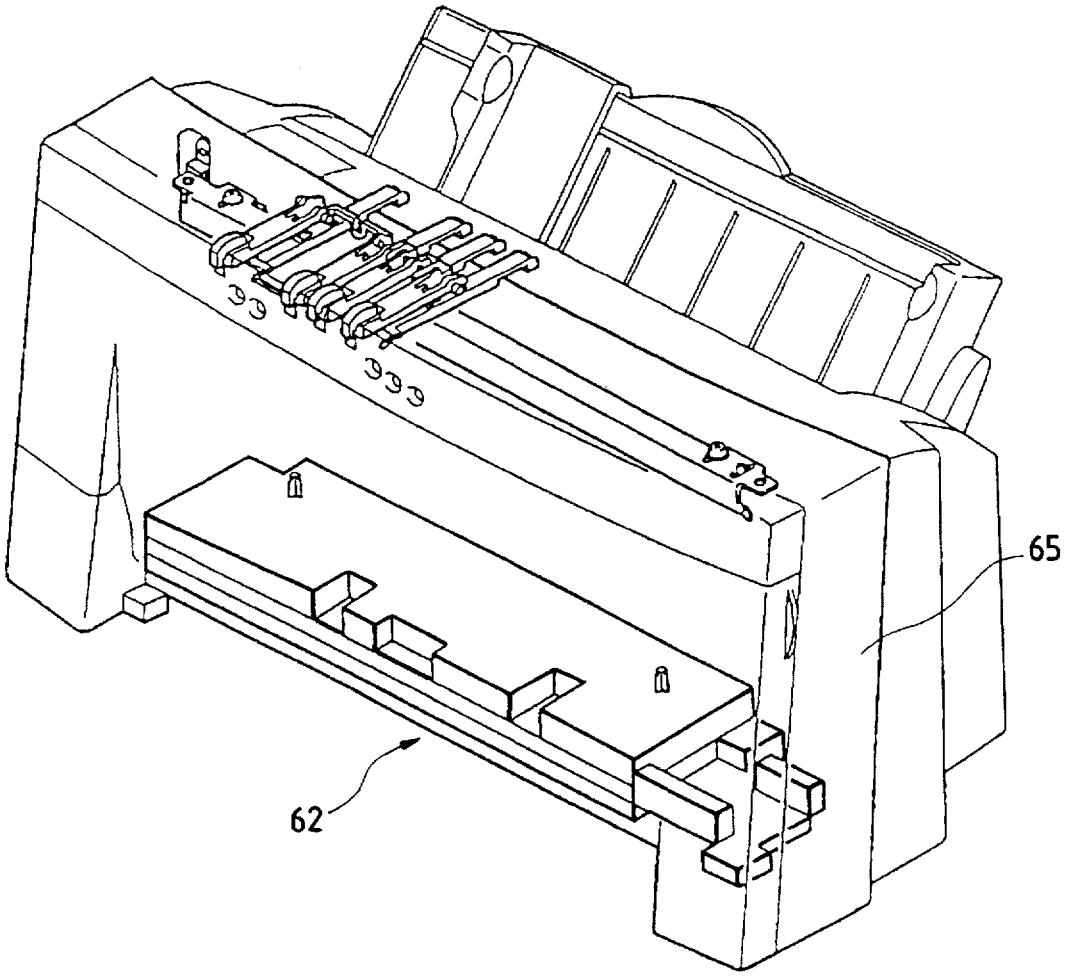
Figure 4:
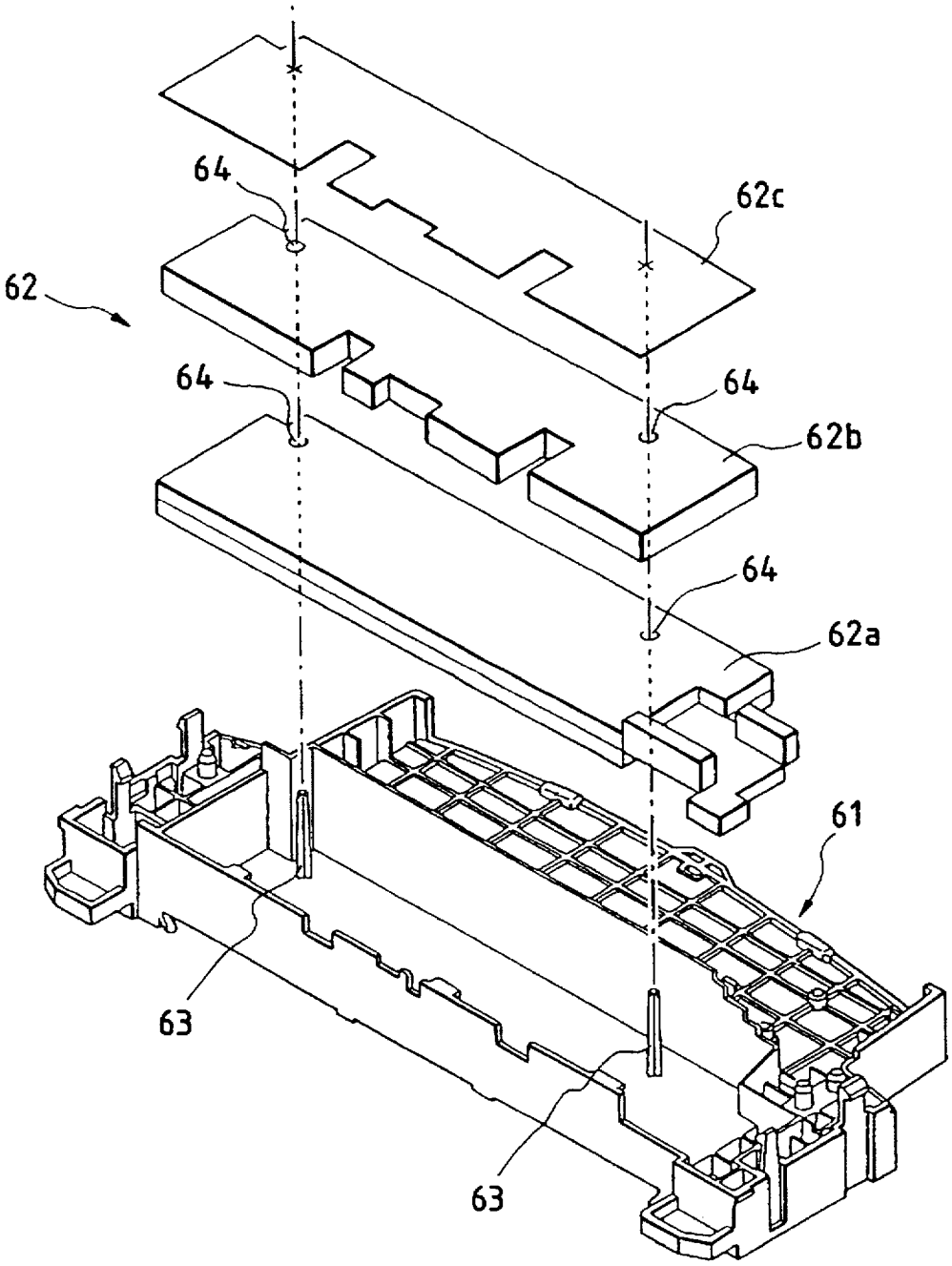
FIG. 4 is an exploded perspective view of an exhaust ink tank position shown in FIG. 3.

As shown in FIG. 3 which shows the external appearance of the whole apparatus and FIG. 4 which shows the exhaust ink tank thereof in its exploded state, the sucked ink is discharged into an ink absorbing member 62 in an exhaust ink tank 61 contained in the lower portion of the apparatus body. This ink absorbing member 62 is removably mountable with respect to the exhaust ink tank 61 and comprises a lower ink absorbing member **62*a*, an upper ink absorbing member 62*b* and a cover sheet 62*c* differing in thickness from one another, the lower ink absorbing member 62*a* and the upper ink absorbing member 62*b* being formed of a porous or fibrous material. These ink absorbing members 62*a* and 62*b* are formed with positioning holes 64 through which a pair of positioning pins 63 protrudely provided on the exhaust ink tank 61 may be passed, whereby the position of the ink absorbing member 62 relative to the exhaust ink tank 61 may be prevented from deviating. As required, the upper cover 65** of the apparatus body may be removed to interchange with a new one by an operator.

That is, the amount of exhaust ink discharged by the recovery process is counted on the basis of the frequency or the like of the recovery process, and its cumulative amount is written into EEPROM, not shown, incorporated in the apparatus body. Thereby, when the cumulative amount of exhaust ink from immediately after the start of recording approximates to the absorption limit of the ink absorbing member 62, an error process may be carried out so that the printing operation or the like may be stopped. On the basis of this error process, the operator can perform the interchange of the ink absorbing member 62. This interchange may be designed to be done by a user, but because the frequency of interchange is small, it is preferable that if be designed to be done by only special technicians.

Figure 5:
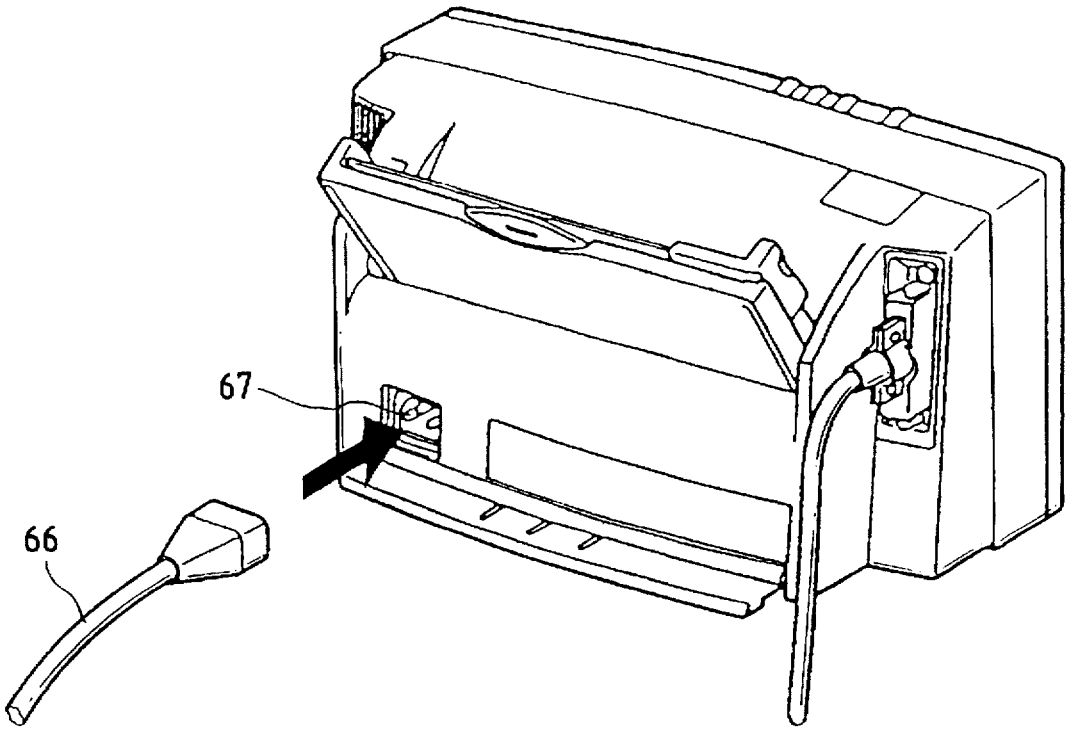
FIG. 5 is a perspective view showing the back of the ink jet printer in the present embodiment.

When the data of the EEPROM after the interchange is to be reset, a power supply cord 66 is connected to a connector 67 provided on the back side of the apparatus body, with a power source switch, not shown, provided on the apparatus body closed, as shown in FIG. 5 which shows the shape of the back of the apparatus body in the present embodiment, and changeover is effected to a factory mode which is a mode capable of being handled by only special technicians, whereafter an FF button, not shown, provided on the apparatus body is depressed, and after alarm sound rings, the operation of opening the power source switch is performed to thereby accomplish the resetting of the data of the EEPROM.

(First Embodiment)

Figure 6:
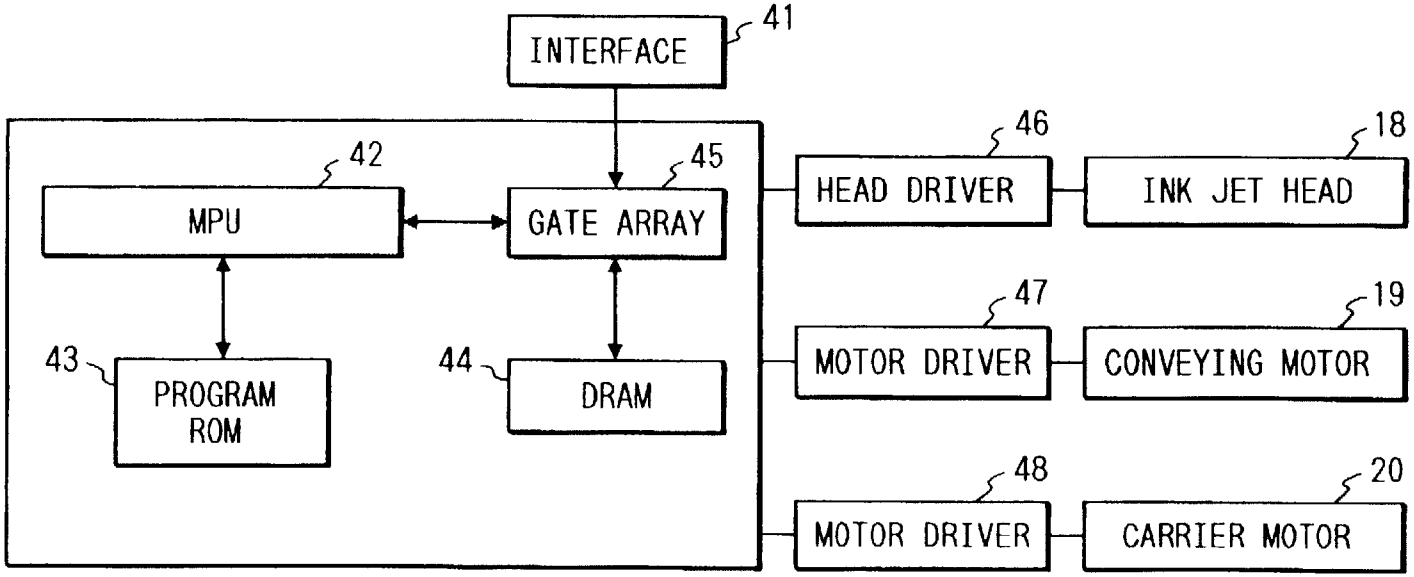
FIG. 6 is a control block diagram of the embodiment shown in FIGS. 1 and 2.

FIG. 6 shows the block construction of the control mechanism of the printer portion in this embodiment. As shown in FIG. 6, the reference numeral 41 designates an interface for inputting a print signal, and the reference numeral 42 denotes a microprocessor unit (hereinafter referred to as the MPU). The reference numeral 43 designates a program ROM storing therein a control program executed by the MPU 42, and the reference numeral 44 denotes a DRAM for preserving therein the above-mentioned print signal and various data including print data supplied to the ink jet head 18. The DRAM 44 is capable of storing therein the number of print dots, the frequency of interchange of the ink jet head 18, etc. as well. The reference numeral 45 designates a gate array for effecting the supply and control of the print data to the ink jet head 18. The gate array 45 is adapted to effect also the control of the transfer of data among the interface 41 and the MPU 42 and the DRAM 44. The reference numeral 20 denotes a carrier motor for conveying the ink jet head 18, and the reference numeral 19 designates a conveying motor for conveying printing paper. The reference numeral 46 denotes a head driver for driving the ink jet head 18, and the reference numerals 47 and 48 designate motor drivers for driving the conveying motor 19 and the carrier motor 20, respectively.

Figure 7:
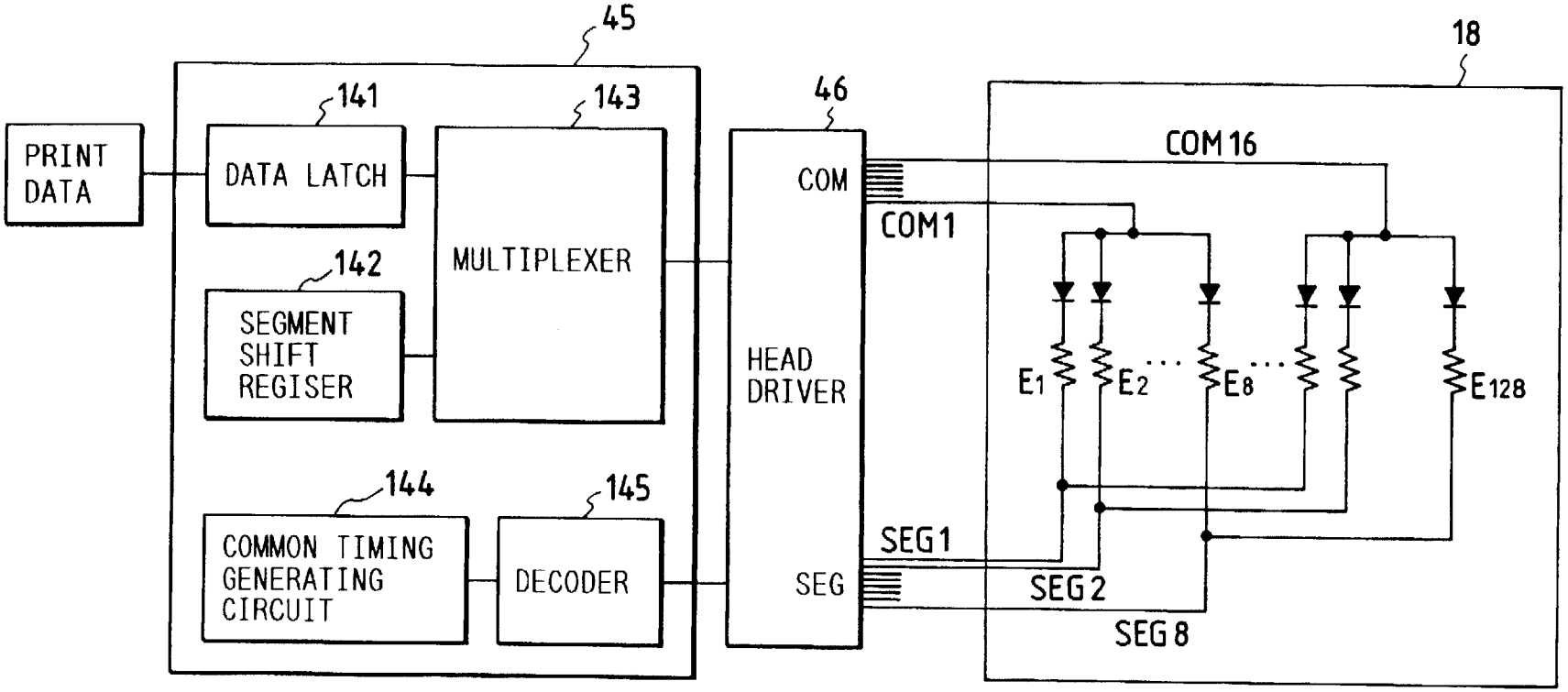
FIG. 7 is a circuit diagram of the portions of the control blocks shown in FIG. 6.

FIG. 7 shows the circuit of the control mechanism of the printer portion shown in FIG. 6. As shown in FIG. 7, the gate array 45 has a data latch 141, a segment shift register 142, a multiplexer 143, a common timing generating circuit 144 and a decoder 145. The ink jet head 18 adopts a diode matrix construction, and a driving current flows to the electro-thermal conversion elements 1e (in the present embodiment, $E_1$–$E_{128}$) in which a common signal COM and a segment signal SEG coincide with each other, whereby the ink is heated and is discharged from each discharge port 1*b*.

The decoder 145 decodes the timing generated by the common timing generating circuit 144 and selects one of common signals COM1–COM16. The data latch 141 latches the print data read out from the DRAM 44 at a unit of 8 bits, and the multiplexer 143 outputs this print data as segment signals SEG1–8 in accordance with the segment shift register 142. The output from the multiplexer 143 can be variously changed to any of 1-bit unit, 2-bit unit and 8-bit unit, depending on the content of the segment shift register 142.

The operation of the above-described control means will now be described. When the print signal enters the interface 41, the print signal is converted into print data for printing between the gate array 45 and the MPU 42. The motor drivers 47 and 48 are then driven and also the ink jet head 18 is driven in accordance with the print data sent to the head driver 46, whereby printing is effected.

Figure 8:
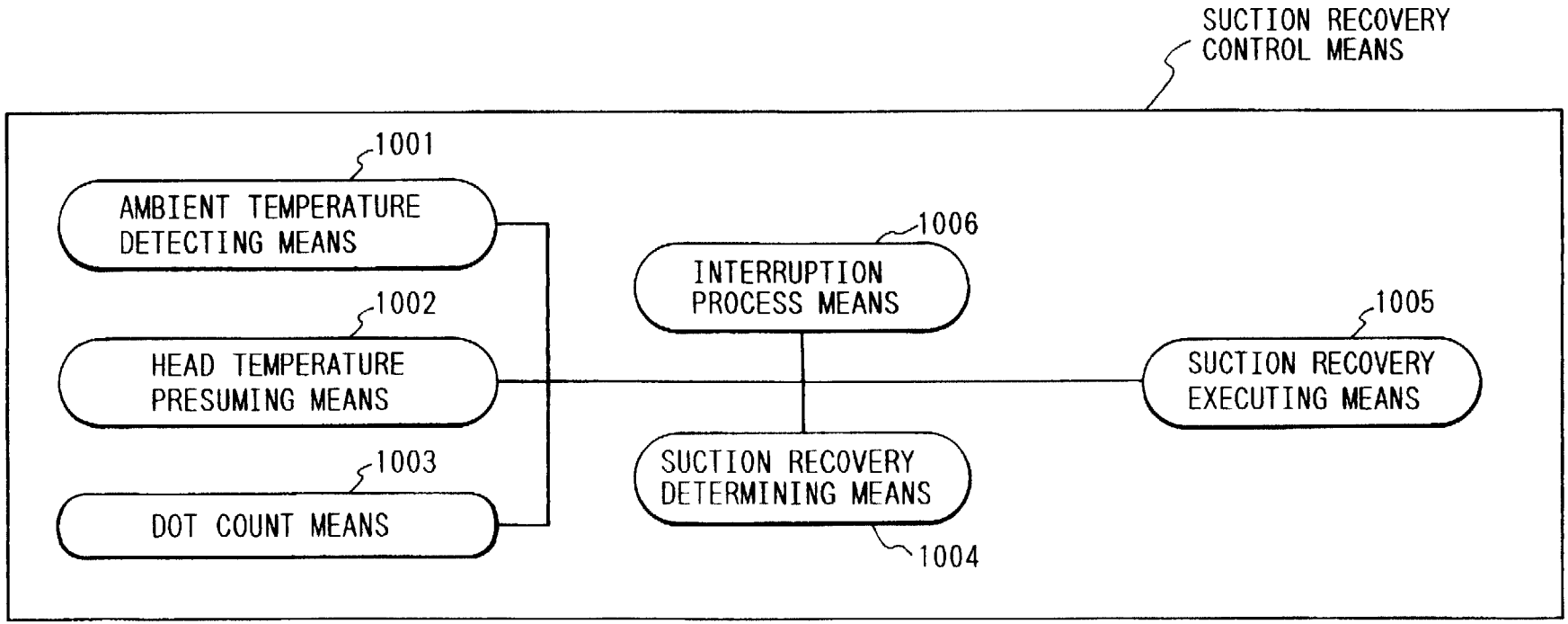
FIG. 8 is a block diagram of suction recovery control means in the present embodiment.

The construction of suction recovery control means in the present embodiment is shown in FIG. 8. That is, the suction recovery control means in the present embodiment is comprised of ambient temperature detecting means 1001 for detecting the ambient temperature of the ink jet head 18, head temperature presuming means 1002 for presuming the temperature of the vicinity of the ink paths 1*d* or the common ink chamber 1*c* in the ink jet head 18, dot count means 1003 for counting the number of dots discharged from the discharge ports 1*b* of the ink jet head 18, suction recovery executing means 1005 for executing the suction recovery operation, interruption process means 1006 for effecting interruption for a predetermined time and under a predetermined condition, and suction recovery determining means 1004 for carrying out a process for determining the period of the next suction recovery operation.

Figure 9:
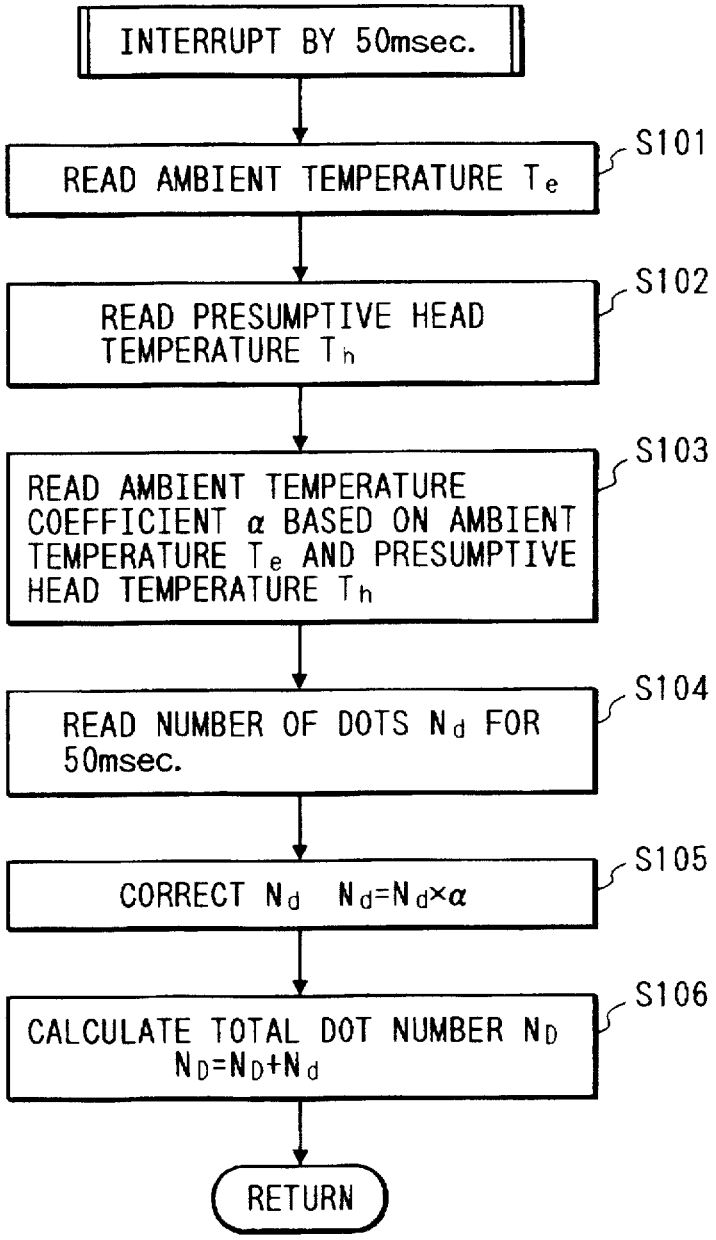
FIG. 9 is a flow chart showing the flow of 50 msec. interruption process in the suction recovery control means shown in FIG. 8.
Figure 10:
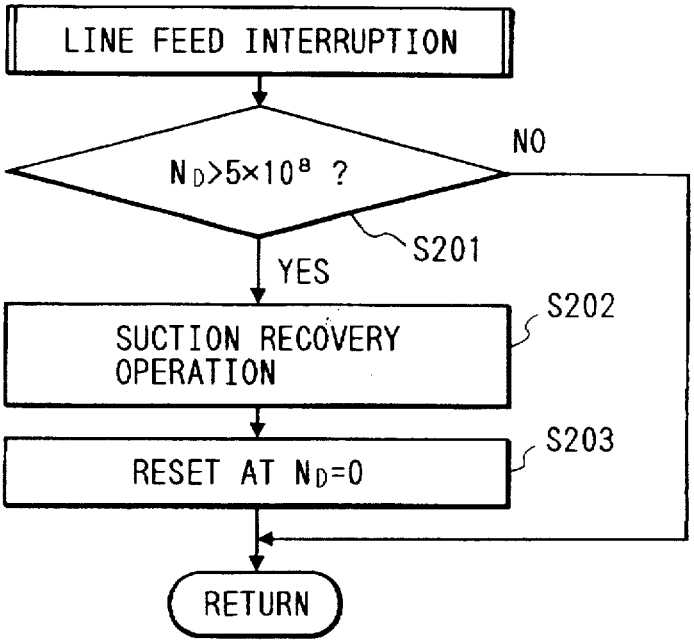
FIG. 10 is a flow chart showing the flow of a line feed interruption process in the suction recovery control means shown in FIG. 8.

The flow of the process of the suction recovery control means in the present embodiment is shown in FIGS. 9 and 10. The suction recovery determining means 1004 in the present embodiment carries out the process of interruption by 50 msec. shown in FIG. 9 and the process of interruption by each line feed shown in FIG. 10 to thereby determine the execution timing of the next suction recovery.

In the process of interruption by 50 msec. shown in FIG. 9, at a step S101, the ambient temperature $T_e$ is read by the ambient temperature detecting means 1001. For the detection of this ambient temperature $T_e$, use may be made of any conventional means which can detect the ambient temperature of the ink jet head 18, but it is desirable to provide a thermistor or the like in a portion capable of accurately detecting the temperature of the ink in the ink tank holding therein the ink to be supplied to the common ink chamber 1*c*, and monitor the value of this thermistor.

Next, at a step S102, the presumptive head temperature $T_h$ is read by the head temperature presuming means 1002. Here, the presumptive head temperature $T_h$ refers to the temperature to which the ink paths 1*d* and common ink chamber 1*c* in the ink jet head 18 have been raised by the electro-thermal conversion elements 1*e*. When finding this presumptive head temperature $T_h$, it is preferable to calculate it on the basis of energy applied to the ink jet head, as disclosed in Japanese Laid-Open Patent Application No. 5-208505, but use may be made of a construction in which on a silicon chip on which the electro-thermal conversion elements 1*e* are formed, an element such as a diode sensor capable of detecting temperature is integrally formed in advance by a semiconductor processing step for manufacturing the ink jet head and the detection value from this diode sensor is monitored.

Then, at a step S103, an ambient temperature coefficient $\alpha$ shown in Table 1 below is read on the basis of the ambient temperature $T_e$ and the presumptive head temperature $T_h$. This ambient temperature coefficient $\alpha$ is for weighing the number of dots $N_d$ for 50 msec. hitherto read at a step S104, on the basis of the difference $\Delta T$ between the presumptive head temperature $T_h$ of the vicinity of the ink paths 1*d* or the common ink chamber 1*c* and the ambient temperature $T_e$ of the ink jet head 18.

Generally, the amount of gas dissolvable in ink depends on temperature. The lower is the temperature of the ink, the more the gas is dissolved in the ink, and conversely, the higher is the temperature of the ink, the more difficult becomes for the gas to be dissolved in the ink. That is, when ink which has been low in temperature at first is gradually warmed, the dissolved gas in the ink is deposited as air bubbles.

As the ink is continuously discharged from the ink jet head 18, the presumptive head temperature $T_h$ of the vicinity of the common ink chamber 1*c* becomes higher than the ambient temperature $T_e$ in the ink tank. When fresh ink in the ink tank which is relatively low in temperature is supplied to the common ink chamber 1*c* which is relatively high in temperature, the deposition of gas by a temperature rise is liable to occur because the ink contains more dissolved gas. If too much gas collects in the common ink chamber 1*c*, no ink will become present near the electro-thermal conversion element which are the discharge means in the ink paths, and unsatisfactory discharge will be caused.

So, when the presumptive head temperature $T_h$ is higher than the ambient temperature $T_e$, at a step S105, the number of dots $N_d$ is multiplied by an ambient temperature coefficient $\alpha$ matching the temperature difference therebetween to thereby increase the apparent number of dots $N_d$. By doing so, it becomes possible to presume more accurately the amount of air bubbles present in the common ink chamber 1*c*.

TABLE 1

Map of Ambient Temperature Coefficient α

| Ambient Temperature $T_e$ (°C.) | Presumptive head Temperature $T_h$ (°C.) 0–10 | 10–15 | 15–20 | 20–25 | 25–30 | 30–35 | 35–40 | 40–45 | 50–55 |
|---|---|---|---|---|---|---|---|---|---|
| 0–10 | 1.0 | 1.1 | 1.2 | 1.3 | 1.4 | 1.5 | 1.6 | 1.7 | 1.8 |
| 10–15 | 0.9 | 1.0 | 1.1 | 1.2 | 1.3 | 1.4 | 1.5 | 1.6 | 1.7 |
| 15–20 | 0.9 | 0.9 | 1.0 | 1.1 | 1.2 | 1.3 | 1.4 | 1.5 | 1.6 |
| 20–25 | 0.8 | 0.9 | 0.9 | 1.0 | 1.1 | 1.2 | 1.3 | 1.4 | 1.5 |
| 25–30 | 0.8 | 0.8 | 0.9 | 0.9 | 1.0 | 1.1 | 1.2 | 1.3 | 1.4 |
| 30–35 | 0.7 | 0.8 | 0.8 | 0.9 | 0.9 | 1.0 | 1.1 | 1.2 | 1.3 |
| 35–40 | 0.7 | 0.7 | 0.8 | 0.8 | 0.9 | 0.9 | 1.0 | 1.1 | 1.2 |
| 40–45 | 0.6 | 0.7 | 0.7 | 0.8 | 0.8 | 0.9 | 0.9 | 1.0 | 1.1 |
| 50–55 | 0.6 | 0.6 | 0.7 | 0.7 | 0.8 | 0.8 | 0.9 | 0.9 | 1.0 |

At the next step S106, the corrected number of dots N*d* counted for 50 msec. is added to the total number of dots $N_D$ hitherto counted, thereby calculating a new total number of dots $N_D$.

On the other hand, in an interruption process for each line feed shown in FIG. 10, at a step S201, whether the total number of dots $N_D$ being counted at an interval of 50 msec. has reached a predetermined number of dots (in the present embodiment, $5\times10^8$) is judged, and if it is judged that this has reached the predetermined number of dots, at a step S202, the printing work is interrupted and the suction recovery operation is performed, and at a step S203, the total number of dots $N_D$ is reset at 0. If at the step S201, it is judged that the total number of dots $N_D$ has not reached the predetermined value, this interruption process is ended.

While in the present embodiment, the execution process of the suction recovery operation by the suction recovery executing means 1005 is carried out at the timing of line feed interruption each time one line is printed, the present invention is not restricted to the interruption process at said timing, but it is desirable that the interruption process be carried out at timing best suited for the ink jet head 18 or the printing apparatus.

(Second Embodiment)

The above embodiment has been described with respect to an ink jet printer having the ink jet head 18 using a single kind of ink, but it is also possible to apply the present invention to an apparatus using a plurality of kinds of inks. Such an embodiment will hereinafter be described.

Figure 11:
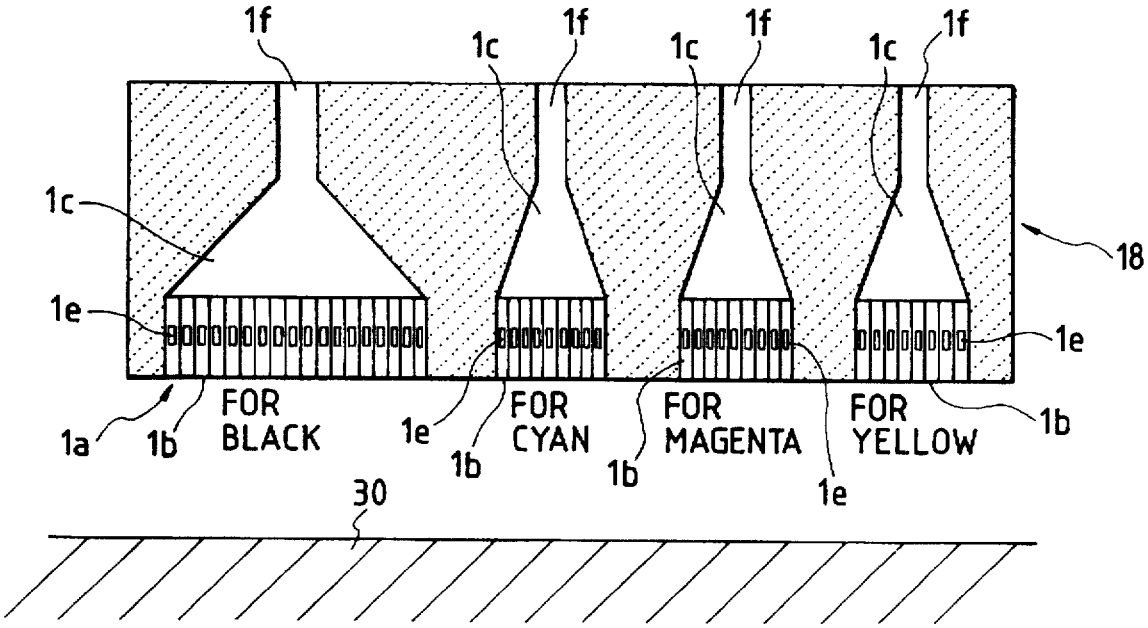
FIG. 11 is a conceptional view schematically showing the structure of an ink jet head in another embodiment of the present invention.

As shown in FIG. 11 which schematically shows the structure of an ink jet head 18 in this embodiment, inks of four colors, i.e., yellow, magenta, cyan and black, are used and correspondingly thereto, discharge ports 1*b* and ink paths 1*d* opening into a discharge port surface 1*a*, electro-thermal conversion elements 1*e*, common ink chambers 1*c* and ink supply paths 1*f* are formed on a single silicon substrate while being divided into four blocks, and each block is provided with an ink tank, not shown. Also, the yellow, magenta and cyan inks are inks of a type which is ready to permeate as compared with the black ink, and which contains a relatively great amount of interfacial active agent and is relatively low in surface tension, and the black ink is ink which is less permeative to the recording paper 30 than the color inks and relatively high in surface tension. This is an important technique which can achieve a good quality of black characters and which is possible to minimize the mutual blur of the color inks.

When printing of only the black ink is continuously effected by the ink jet head 18 of the above-described construction and thereafter a color image is printed, there arises a phenomenon in which the heads corresponding to the color inks become unable to discharge. This arises because in the ink jet head 18 of the above-described construction, the electro-thermal conversion elements 1*e* are formed on the same silicon substrate and even during the printing of the black ink alone, the ink paths 1*d* and common ink chambers 1*c* for colors are heated and air bubbles become liable to be created in the ink paths.

When the discharge of all inks is effected continuously, the lower layer of the common ink chambers 1*c* which is near the electro-thermal conversion elements 1*e* causes a temperature rise in the common ink chambers 1*c* into which inks of relatively low temperature are always supplied from the ink tanks. The upper layer of the common ink chambers 1*c* are always cooled by fresh inks and therefore, the temperature thereof does not so much rise. That is, only the inks near the silicon substrate in the lower layer of the common ink chambers 1*c* become liable to cause the deposition of air bubbles.

In contrast, when only the black ink is continuously discharged and the color inks are scarcely discharged, the temperature of the inks in the common ink chambers 1*c* for color inks gradually rises in the lower layer of the common ink chambers 1*c* which is near the electro-thermal conversion elements 1*e*, but since fresh inks are not supplied thereto from the ink tanks, the convection of the inks occurs in the common ink chambers 1*c* with a result that even the inks in the upper layer of the common ink chambers 1*c* rise in temperature. That is, in spite of the fact that the inks are scarcely discharged and the creation of air bubbles hardly results from the discharge, the quantity of heat possessed by the inks in the common ink chambers 1*c* becomes greater than when the inks are continuously discharged and therefore, the amount of deposition of dissolved gas becomes great, thus causing the above-described inconvenience.

The manner in which the above-described inconvenience occurs differs also depending on the natures of the inks. According to the inventors' experiment, the above-described inconvenience is liable to occur in the case of color ink containing a relatively great quantity of interfacial active agent. This is conceivably because even if the amounts of air bubbles created are equal, the manner of distribution of the air bubbles differs depending on the natures of the inks and in the case of the above-described inks, the gas coupled to the wall surfaces of the common ink chambers 1*c* and the ink supply paths if cannot be completely removed during the suction recovery operation.

According to the present embodiment, there is provided an ink jet apparatus in which the timing at which unsatisfactory discharge occurs due to the air bubbles present in the ink paths 1d or the common ink chambers 1c is presumed from the ambient temperature $T_e$, the presumptive head temperature $T_h$, the frequency of discharge, i.e., the number of dots, of the ink of each color, and the non-print time of the ink of each color and the suction recovery operation is performed immediately before unsatisfactory discharge occurs, whereby the reliability is high and the running cost is low.

Figure 12:
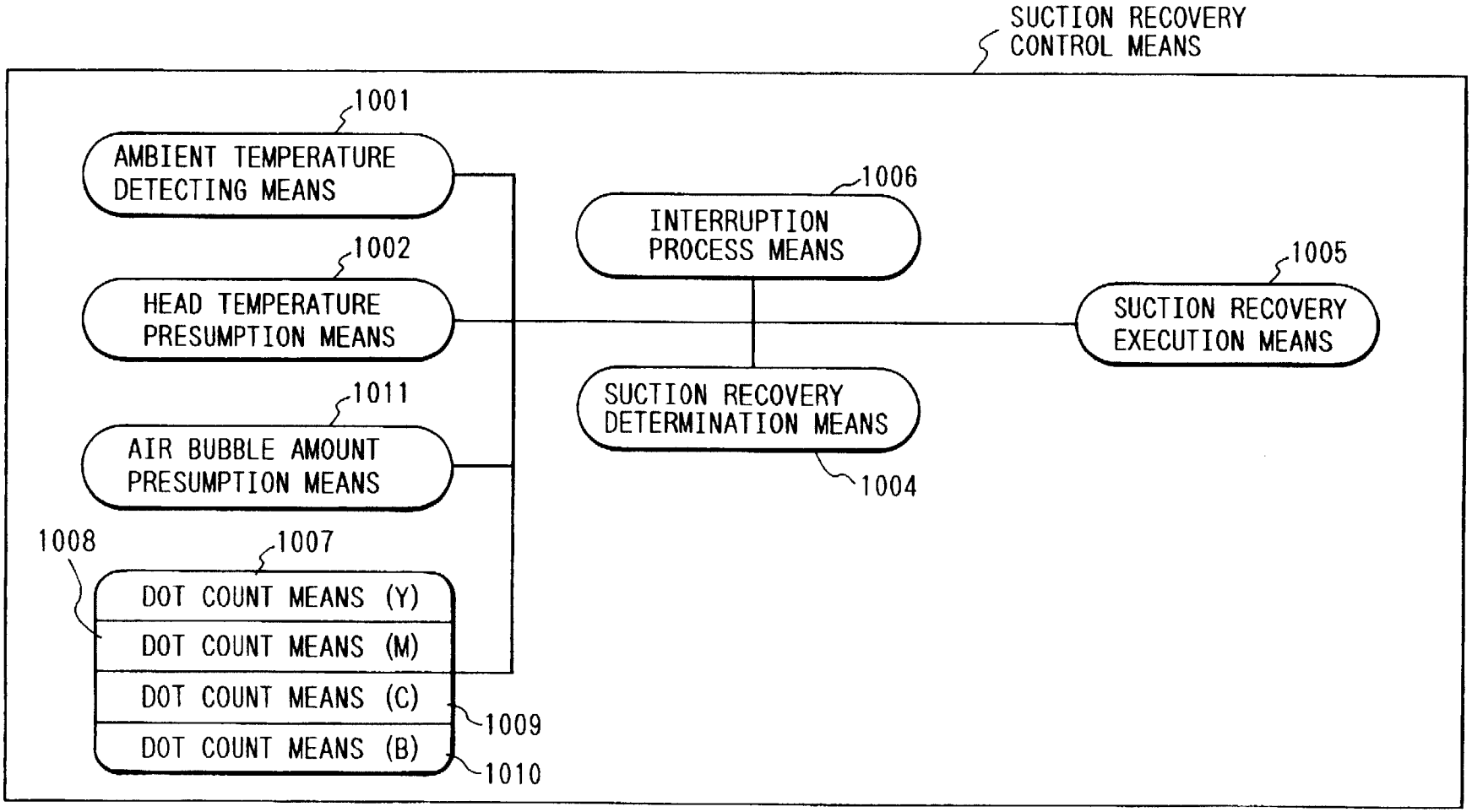
FIG. 12 is a block diagram of suction recovery control means in the embodiment shown in FIG. 11.

FIG. 12 shows the construction of suction recovery control means in such present embodiment. That is, the suction recovery control means is comprised of ambient temperature detecting means 1001 for detecting the ambient temperature $T_e$ of the ink jet head 18, head temperature presumption means 1002 for finding the presumptive head temperature $T_h$ of the vicinity of the ink paths 1d or the common ink chambers 1c in the ink jet head 18, dot count means 1007–1010 for counting the frequencies of discharge, i.e., the numbers of dots, of the inks of respective colors, air bubble amount presumption means 1011 for presuming the amount of air bubbles deposited in the common ink chambers 1c during non-printing, suction recovery execution means 1005 for executing the suction recovery operation, interruption process means 1006 for effecting interruption at a predetermined time interval and under a predetermined condition, and suction recovery determination means 1004 for carrying out a process for determining the period of the next suction recovery operation.

Figure 13:
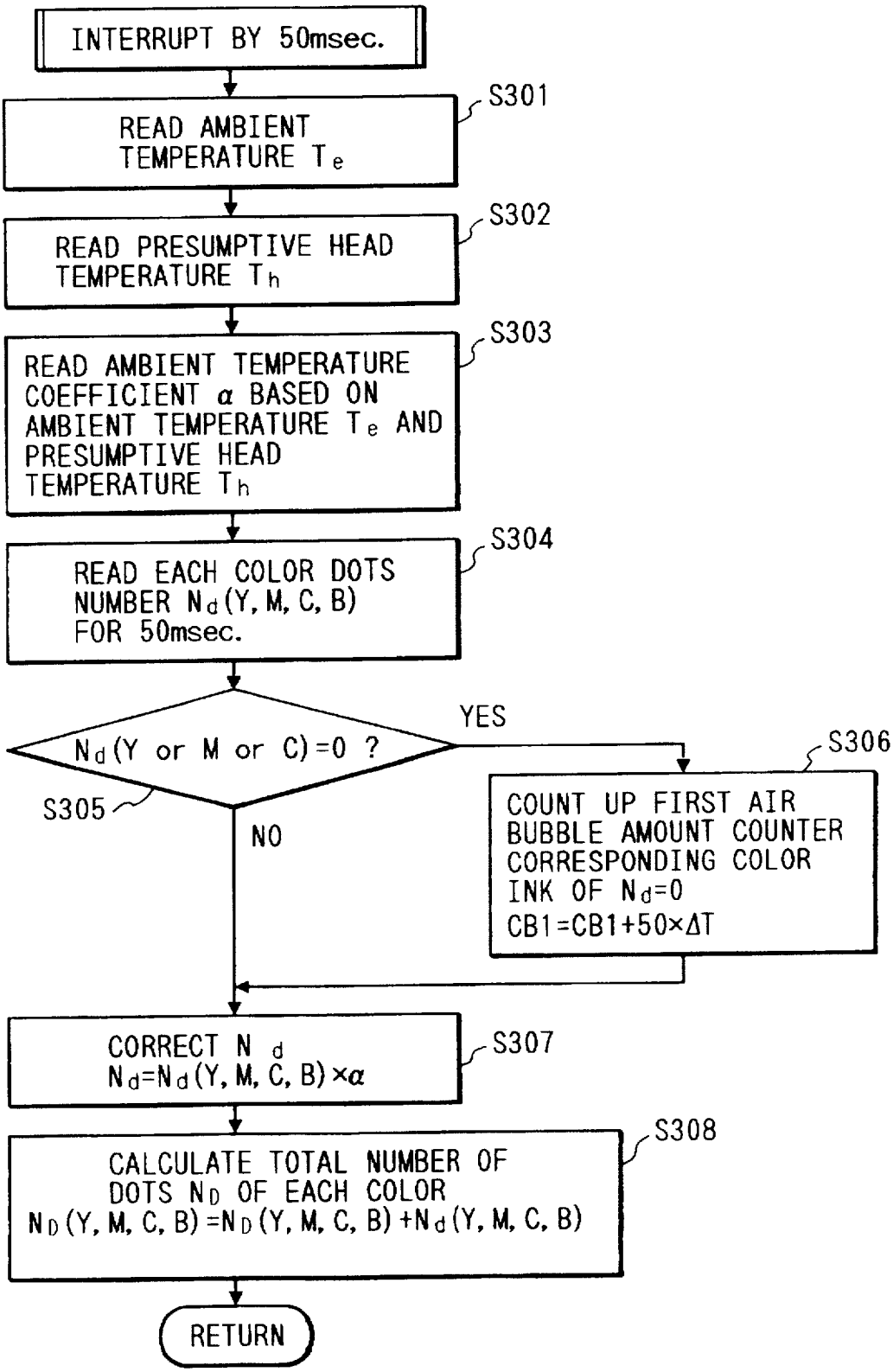
FIG. 13 is a flow chart showing the flow of 50 msec. interruption process in the suction recovery control means shown in FIG. 12.
Figure 14:
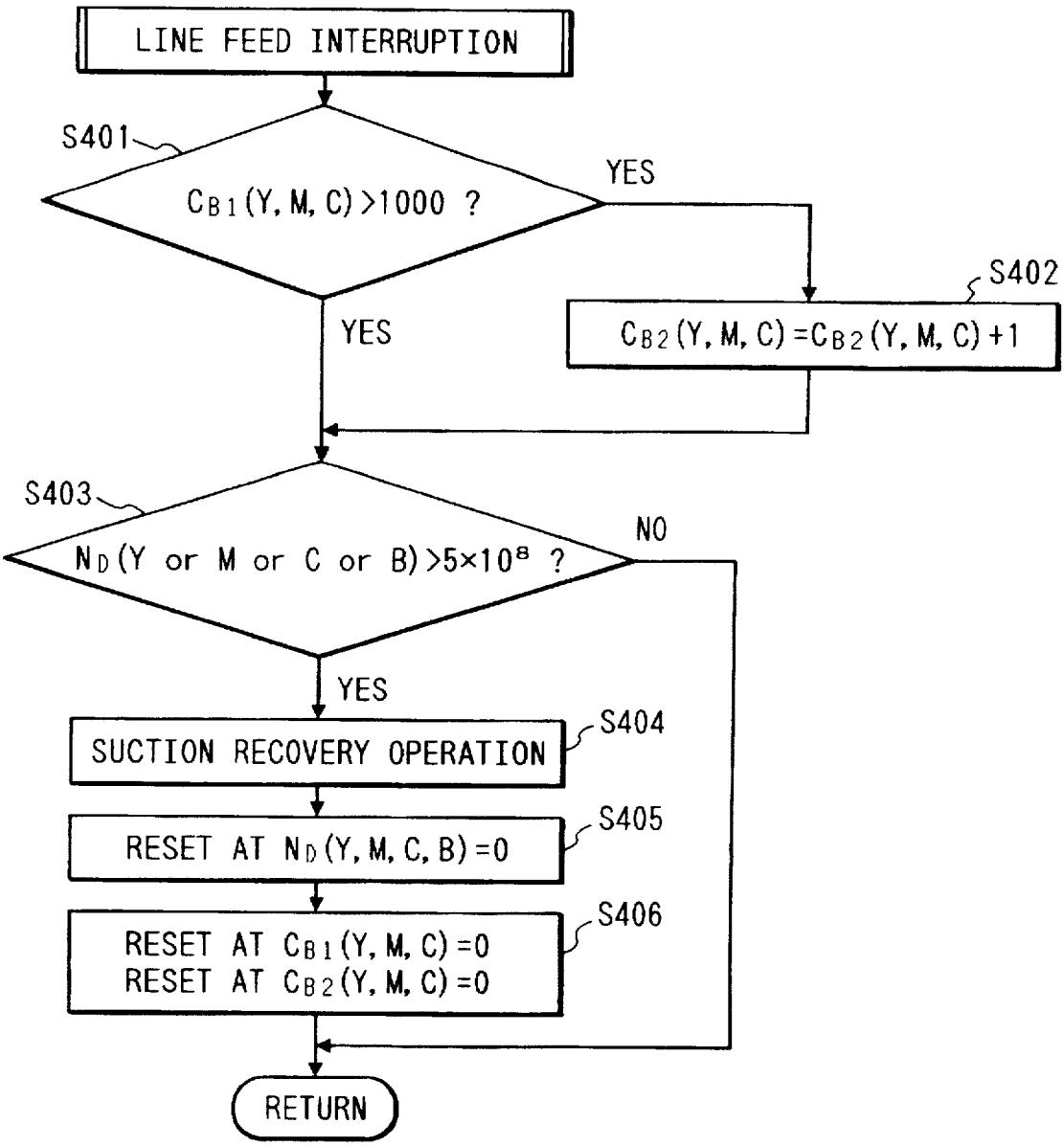
FIG. 14 is a flow chart showing the flow of a line feed interruption process in the suction recovery control means shown in FIG. 12.
Figure 15:
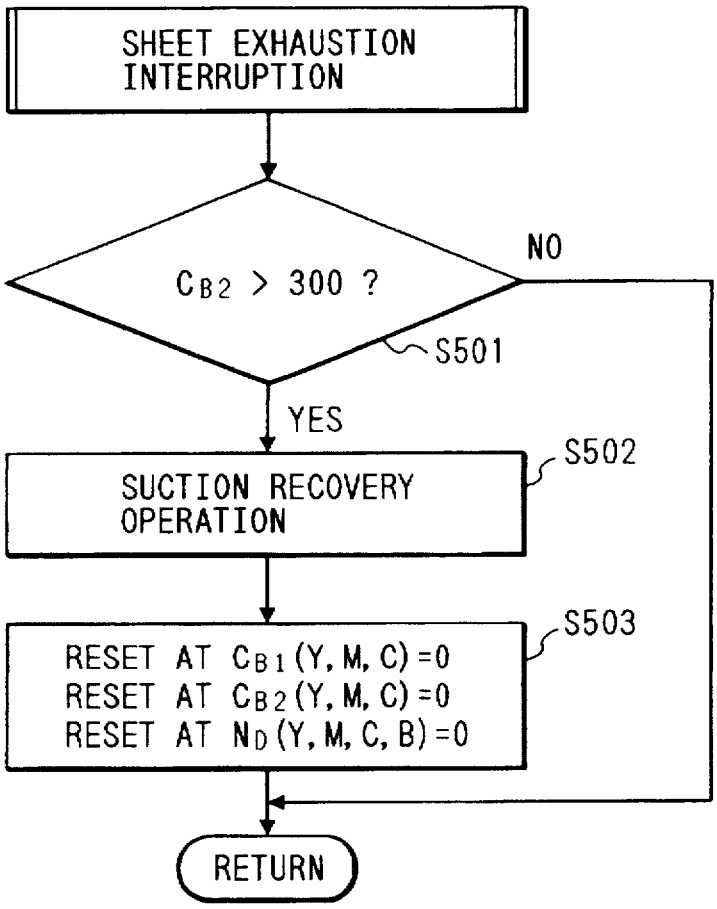
FIG. 15 is a flow chart showing the flow of a sheet exhaustion interruption process in the suction recovery control means shown in FIG. 12.

FIGS. 13 to 15 are flow charts of the suction recovery control means illustrating the present embodiment. That is, the suction recovery determination means 1004 carries out a process of interruption by 50 msec. shown in FIG. 13, a process of interruption for each line feed shown in FIG. 14 and a process of sheet exhaustion interruption shown in FIG. 15 to thereby determine the execution timing of the next suction recovery.

In FIG. 13, at a step S301, the ambient temperature $T_e$, is read by the ambient temperature detecting means 1001, and at a step S302, the presumptive head temperature $T_h$ is read by the head temperature presumption means 1002. At a step S303, the ambient temperature coefficient α stored as shown in FIG. 10 is read from the ambient temperature $T_e$ and the presumptive head temperature $T_h$, and at a step S304, the number of dots $N_d$(Y, M, C, B) for 50 msec. hitherto in each block is read.

Subsequently, whether one of the numbers of dots $N_d$(Y, M, C) corresponding to the color inks is 0 is judged at a step S305, and if it is judged that one of said numbers of dots $N_d$ is 0, shift is made to a step S306, where the count value $C_{B1}$ of a first air bubble amount presumption counter in the block corresponding to the color ink of which the number of dots $N_d$ has become zero, during non-printing, is corrected as follows:

$$C_{B1}=C_{B1}+50\times\Delta T.$$

That is, the air bubble amount presumption means 1010 during non-printing presumes the amount of air bubbles growing in the common ink chamber 1c corresponding to the ink of the color which is not being printed and therefore, with respect to the ink of the color of which the number of dots $N_d$ counted for 50 msec. is 0, it adds to the count value $C_{B1}$(Y, M, C) of the first air bubble amount presumption counter during non-printing a value obtained by multiplying the non-print time (in the present embodiment, 50 msec.) by the difference $\Delta T(=T_h-T_e)$ between the presumptive head temperature $T_h$ of the vicinity of the ink paths 1d or the common ink chambers 1c and the ambient temperature $T_e$, of the ink jet head 18. Also, if at the step S305, it is judged that none of the numbers of dots $N_d$(Y, M, C) corresponding to the color inks is 0, shift is made to a step S307, where if the presumptive head temperature $T_h$ of the ink jet head 18 is higher than the ambient temperature $T_e$, the numbers of dots $N_d$(Y, M, C, B) are each multiplied by the ambient temperature coefficient α matching the temperature difference ΔT therebetween to thereby increase the apparent number of dots $N_d$, and if conversely the presumptive head temperature $T_h$ is lower than the ambient temperature $T_e$, the apparent number of dots $N_d$ is decreased. Thereby, it becomes possible to presume the amount of air bubbles in the common ink chambers 1c more accurately.

Finally, the corrected numbers of dots $N_d$(Y, M, C, B) counted for 50 msec. are added to the total numbers of dots $N_D$(Y, M, C, B) hitherto counted, and this process of interruption by 50 msec. is terminated.

In the interruption for each line feed shown in FIG. 14, at a step S401, whether the count value $C_{B1}$ of the first air bubble amount presumption counter for each color during non-printing has exceeded a predetermined value (in the present embodiment, 1000) is judged, and if there is an ink of a color exceeding the predetermined value, the count value $C_{B2}$(Y, M, C) of a second air bubble amount presumption counter of that color during non-printing is advanced by one, and shift is made to a step S403.

In the present embodiment, the prescribed value of the first air bubble presumption counter 1 is 1000, but it is desirable that this be an optimum value in accordance with the ink jet head 18 or the printing apparatus.

Subsequently, at the step S403, whether the total number of dots $N_D$(Y, M, C, B) of each color has exceeded a predetermined value (in the present embodiment, $5\times10^8$) is judged, and if it is judged that this is equal to or less than the predetermined value, nothing is done but this interruption process is terminated. If at the step S403, it is judged that the total number of dots $N_D$(Y, M, C, B) of each color has exceeded the predetermined value, shift is made to a step S404, where the suction recovery operation is performed. After this suction recovery operation, at a step S405, the total number of dots $N_D$(Y, M, C, B) of each color is reset at 0 and further, at a step S406, the count value $C_{B1}$ of the first air bubble amount presumption counter and the count value $C_{B2}$ of the second air bubble amount presumption counter during non-printing are reset at 0, and this interruption process is terminated.

In the process of sheet exhaustion interruption shown in FIG. 15, at step S501, whether the count value $C_{B2}$ of the second air bubble amount presumption counter for one of the color inks has exceeded a predetermined value (in the present embodiment, 300) is judged, and if it is judged that this has not exceeded the predetermined value, nothing is done but this interruption process is terminated. If at the step S501, it is judged that the count value $C_{B2}$ of the second air bubble amount presumption counter for one of the color inks has exceeded the predetermined value, at a step S502, the suction recovery operation is performed and further, shift is made to a step S503, where the count value $C_{B1}$ of the first air bubble amount presumption counter is reset at 0 and also the count value $C_{B2}$ of the second air bubble amount presumption counter is reset at 0 and further, the total number of dots $N_D$(Y, M, C, B) in each block is reset at 0.

Thus, in the present embodiment, as described in the previous embodiment, the temperature correction during printing is effected to the number of dots discharged by the ink jet head 18, from the ambient temperature $T_e$ and the presumptive head temperature $T_h$, and the number of dots $N_D$ is counted and at the same time, in order to presume the amount of air bubbles during printing, the blocks which have not printed while a sheet of recording paper is printed is counted by the product (50×ΔT shown in the present embodiment) of the interruption time (in the present embodiment, 50 msec.) and the difference ΔT between the presumptive head temperature $T_h$ and the ambient temperature $T_e$, and the next suction recovery period is determined by earlier one of the number of dots $N_D$ and the non-printing time.

Also, in the present embodiment, the non-print time of the ink of the color being not discharged is counted and corrected at the timing-of the interruption by 50 msec. each and the interruption for each line feed, and the discrimination of the execution process of the suction recovery operation is done at the timing of the sheet exhaustion interruption, whereas the present invention is not restricted to the interruption process at said timing, but it is desirable that the process be carried out at process timing best suited for the ink jet head 18 or the printing apparatus.

(Third Embodiment)

Description will now be made of another embodiment of the present invention in which the timing at which unsatisfactory discharge occurs due to air bubbles present in the ink paths 1*d* and the common ink chambers 1*c* is presumed from the ambient temperature $T_e$, the presumptive head temperature $T_h$, the number of dots $N_D$ of the ink jet head 18 and the amount of ink discharge during printing and the suction recovery operation is performed immediately before unsatisfactory discharge occurs, whereby reliability can be made high and running cost can be made low.

Figure 16:
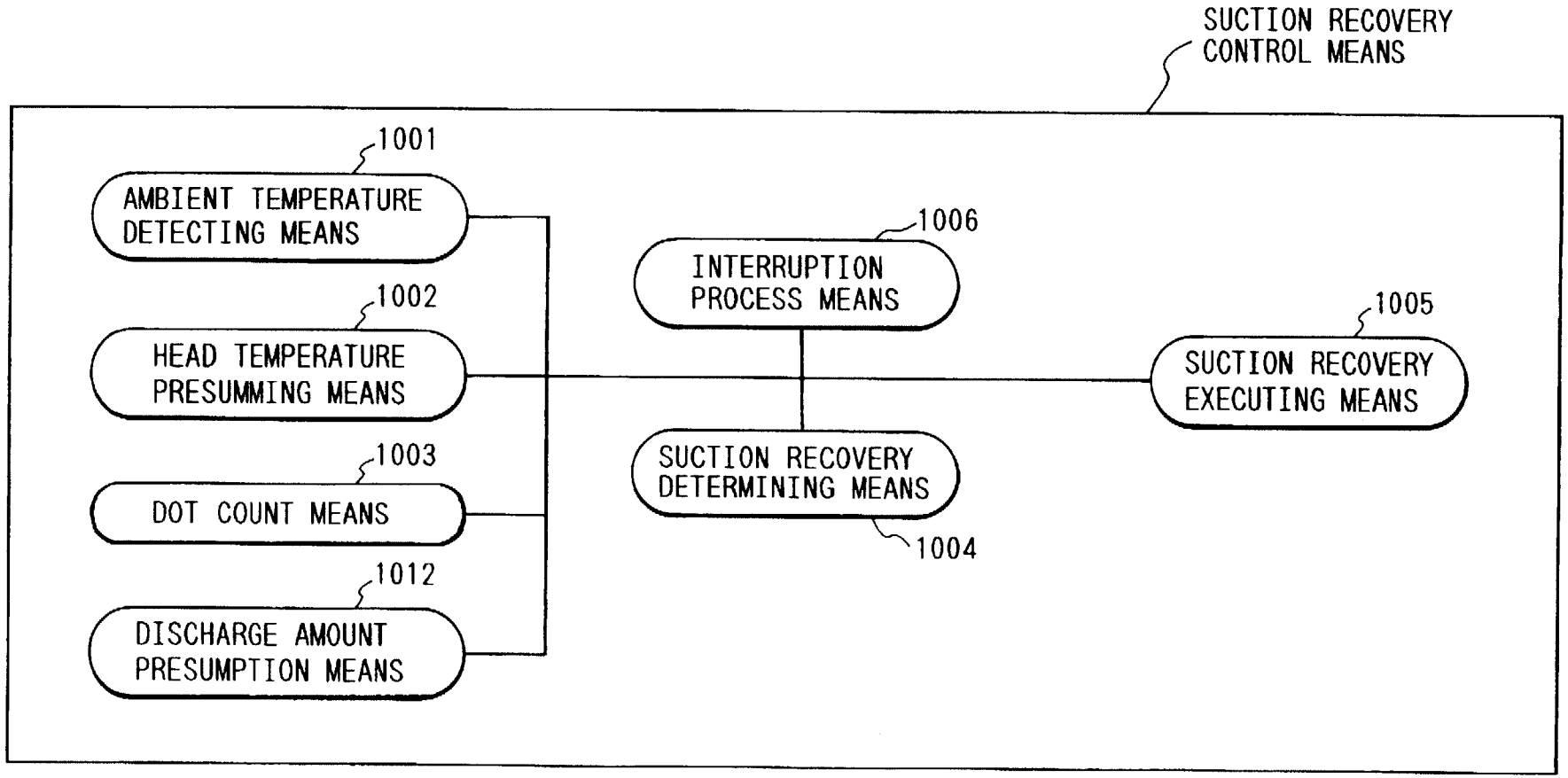
FIG. 16 is a block diagram of suction recovery control means in still another embodiment of the present invention.

FIG. 16 shows the construction of suction recovery control means in this embodiment. That is, this suction recovery control means is comprised of ambient temperature detecting means 1001 for detecting the ambient temperature of the ink jet head 18, head temperature presumption means 1002 for presuming the temperature of the vicinity of the ink paths 1*d* and common ink chamber 1*c* in the ink jet head 18, dot count means 1003 for counting the number of dots discharged by the ink jet head 18, suction recovery execution means 1005 for executing the suction recovery operation, ink discharge amount presumption means 1012, interruption process means 1006 for effecting interruption at a predetermined time interval and under a predetermined condition, and suction recovery determination means 1004 for carrying out a process for determining the period of the next suction recovery operation.

Figure 17:
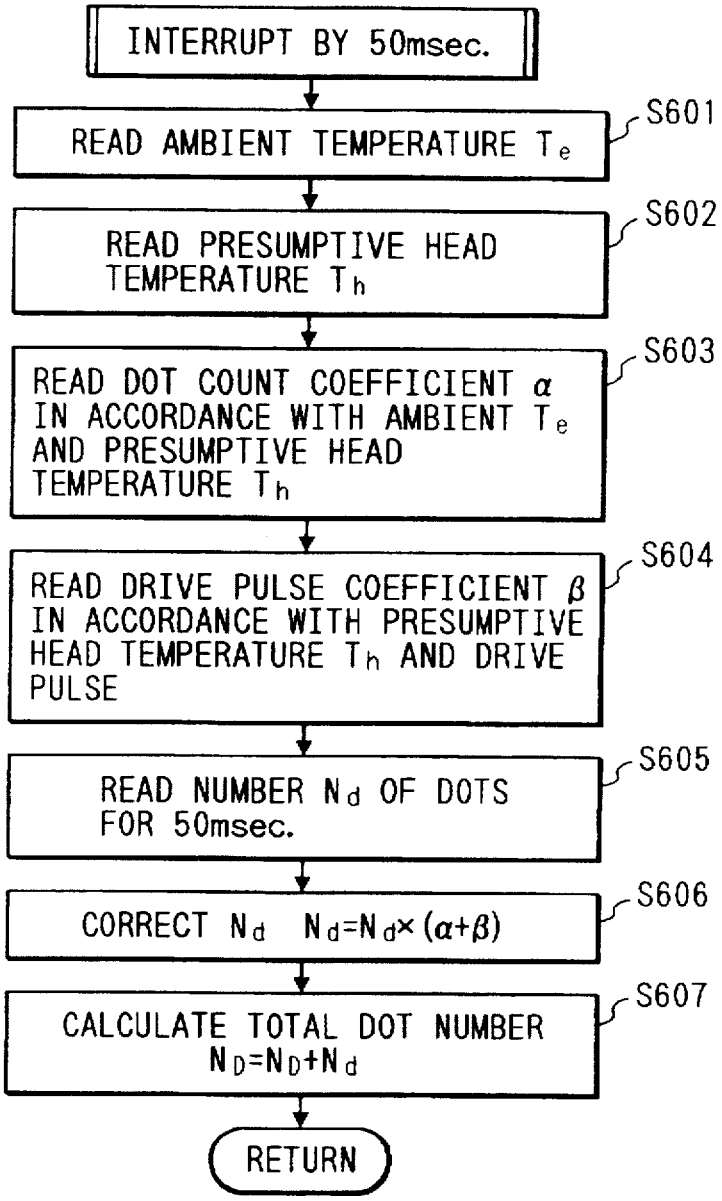
FIG. 17 is a flow chart showing the flow of 50 msec. interruption process in the suction recovery control means shown in FIG. 16.
Figure 18:
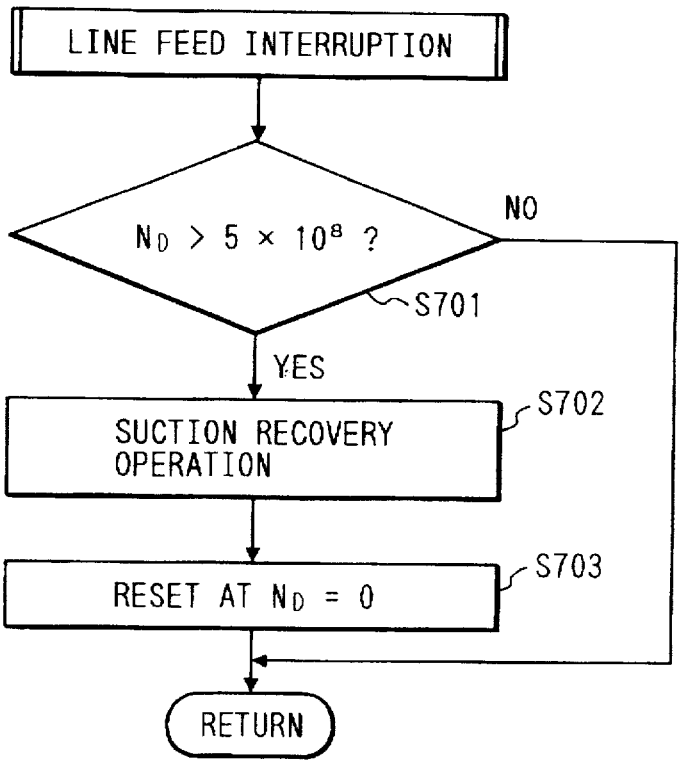
FIG. 18 is a flow chart showing the flow of a line feed interruption process in the suction recovery control means n in FIG. 16.

FIGS. 17 and 18 show the process procedure by this suction recovery control means. FIG. 17 shows the process of interruption by 50 msec. each. As shown in FIG. 17, at a step S601, the ambient temperature $T_e$ is read by the ambient temperature detecting means 1001, and at the next step S602, the presumptive head temperature $T_h$ is read by the head temperature presumption means 1002. At a step S603, the ambient temperature coefficient a stored as shown in FIG. 10 is read from the ambient temperature $T_e$, and the presumptive head temperature $T_h$, and at the next step S604, a drive pulse coefficient β determined on the basis of the presumptive head temperature $T_h$ and the downtime of the drive pulse of the ink jet head 18 is read from a map shown in Table 2 below.

TABLE 2

Map of Ambient Temperature Coefficient β

| Drive pulse downtime (μs) | Presumptive head Temperature $T_h$ (°C.) 0–10 | 10–20 | 20–25 | 25–30 | 30–35 | 35–40 | 40–45 | 45–50 | 50–55 |
|---|---|---|---|---|---|---|---|---|---|
| 0.0–0.36 | 0.0 | 0.05 | 0.1 | 0.2 | 0.3 | 0.4 | 0.5 | 0.6 | 0.7 |
| 0.36–0.72 | 0.0 | 0.05 | 0.1 | 0.2 | 0.3 | 0.4 | 0.5 | 0.6 | 0.7 |
| 0.72–1.08 | 0.05 | 0.1 | 0.2 | 0.3 | 0.4 | 0.5 | 0.6 | 0.7 | 0.8 |
| 1.08–1.44 | 0.05 | 0.1 | 0.2 | 0.3 | 0.4 | 0.5 | 0.6 | 0.7 | 0.8 |
| 1.44–1.8 | 0.075 | 0.15 | 0.3 | 0.4 | 0.5 | 0.6 | 0.7 | 0.8 | 0.9 |
| 1.8–2.16 | 0.075 | 0.15 | 0.3 | 0.4 | 0.5 | 0.6 | 0.7 | 0.8 | 0.9 |
| 2.16–2.52 | 0.1 | 0.2 | 0.4 | 0.5 | 0.6 | 0.7 | 0.8 | 0.9 | 1.0 |
| 2.52–2.88 | 0.1 | 0.2 | 0.4 | 0.5 | 0.6 | 0.7 | 0.8 | 0.9 | 1.0 |
| 2.88–3.24 | 0.125 | 0.25 | 0.5 | 0.6 | 0.7 | 0.8 | 0.9 | 1.1 | 1.2 |

Figure 22:
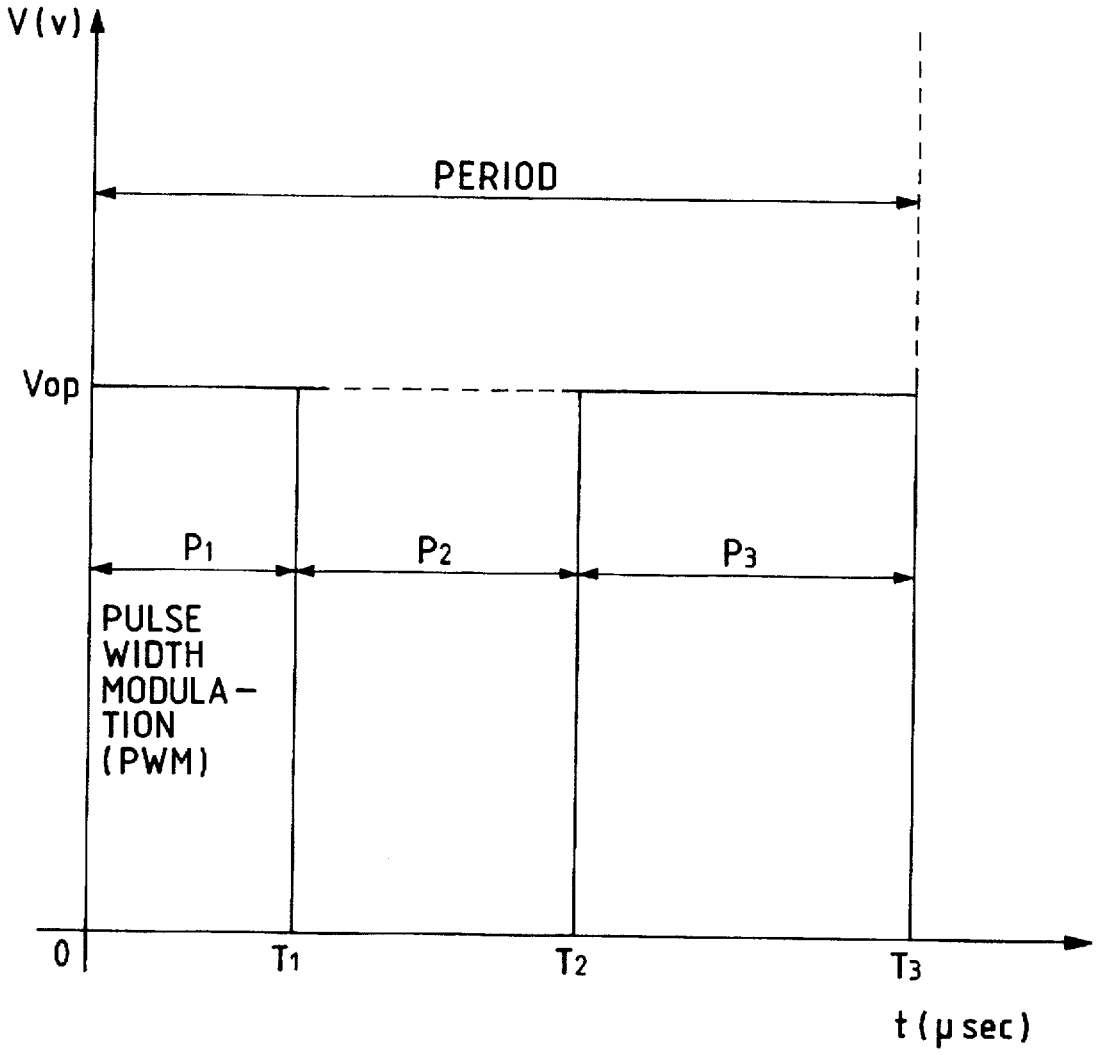
FIG. 22 illustrates a drive pulse by PWM.

The drive control of the ink jet head 18 in the present embodiment is effected by applying to the electro-thermal conversion elements 1*e* a pulse voltage comprised of a first heat pulse (prepulse) P1 as shown in FIG. 22, a second heat pulse (main pulse) P3 and the downtime (off time) P2 between these pulses. Design is made such that by modulating the downtime P2 between the first and second heat pulses, it is possible to vary the amount of ink discharge. In the ink jet head 18 of the same instruction, when printing is effected by a relatively great amount of ink discharge, the amount of bubbles created in the ink paths increases as compared with a case where printing is effected by a relatively small amount of ink discharge.

Also, as the presumptive head temperature $T_h$ becomes higher, the amount of ink discharge becomes greater even if the ink jet head is driven by the same drive pulse, and as a result, the amount of bubbles created in the ink paths increases. When conversely, the drive pulse becomes greater, that is, the width of the downtime becomes greater, the amount of ink discharge becomes greater even at the same presumptive head temperature $T_h$, and as a result, the amount of bubbles created in the ink paths increases.

So, in the present embodiment, the result of the addition of the ambient temperature coefficient α described in the first embodiment and the drive pulse coefficient β determined by the presumptive head temperature $T_h$ and the downtime P2 of the drive pulse to the number of dots $N_d$ for 50 msec. hitherto read at a step S605 is integrated at a step S606, whereby the amount of air bubbles created in the common ink chambers 1*c* can be presumed more accurately. At a step S607, the total number of dots $N_D$ is calculated on the basis of the corrected number of dots $N_d$ for 50 msec.

On the other hand, as shown in FIG. 18 which shows the process of interruption for each line feed, at a step S701, whether the total number of dots $N_D$ has exceed a predetermined value (in the present embodiment, $7\times10^8$) is judged, and if it is judged that this has exceeded the predetermined value, shift is made to a step S702, where the suction recovery operation is performed, and further at a step S703, the total number of dots $N_D$ is reset at 0, and this interruption process is terminated. Thereby, it becomes possible to perform the suction recovery operation reliably immediately before unsatisfactory print by air bubbles occurs.

(Fourth Embodiment)

Description will now be made of a simple embodiment of an ink jet apparatus provided with an ink jet head 18 for discharging a plurality of inks differing in nature.

This embodiment adopts the ink jet head 18 as shown in FIG. 11, and yellow, magenta and cyan color inks are inks which contain a relatively great amount of interfacial active agent and which are relatively low in surface tension and high in permeability, and black ink is ink which is relatively high in surface tension and is not liable to permeate.

Figure 19:
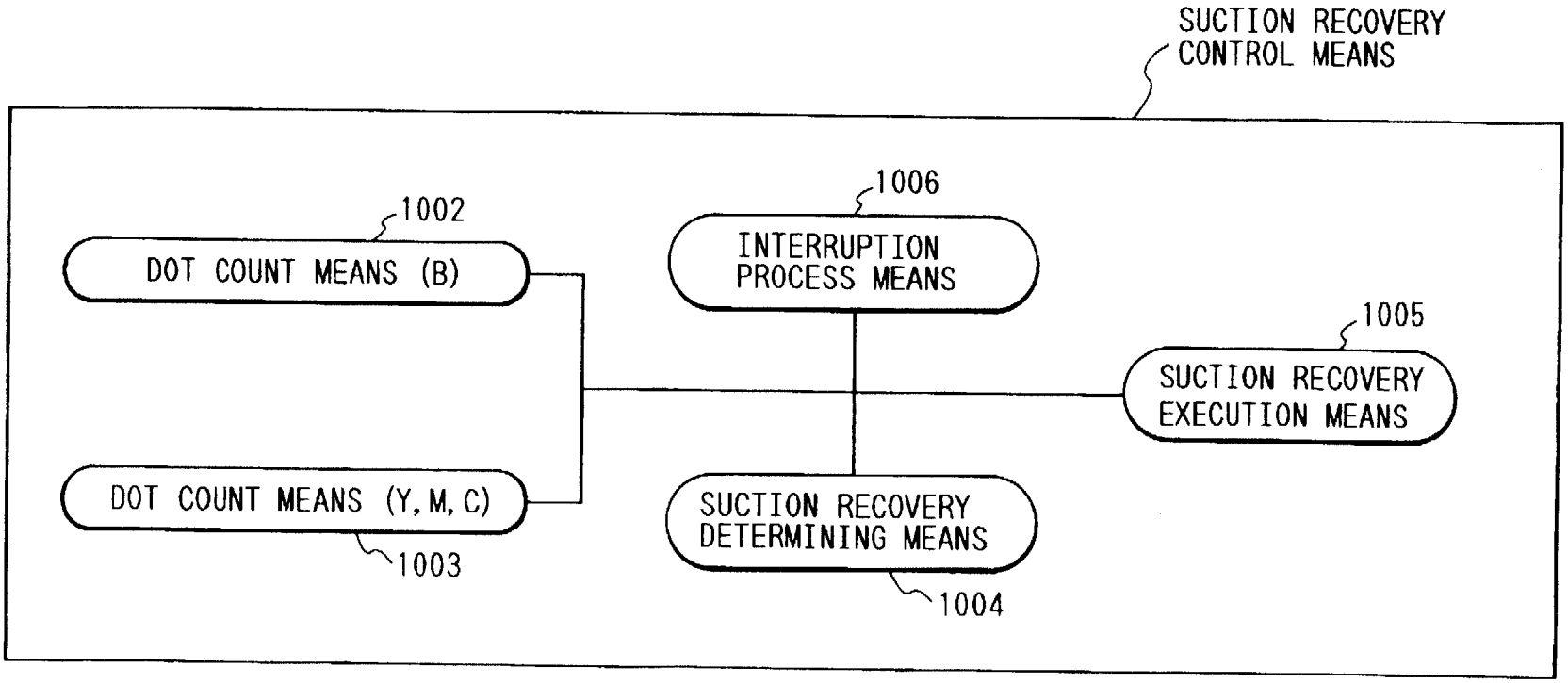
FIG. 19 is a block diagram of suction recovery control means in yet still another embodiment of the present invention.

FIG. 19 shows the construction of suction recovery control means in the present embodiment. That is, this suction recovery control means is comprised of dot count means (for black) 1002 for counting the frequency of discharge of black ink, dot count means (for yellow, magenta and cyan) 1003 for counting the frequencies of discharge of color inks (yellow, magenta and cyan), suction recovery execution means 1005 for executing the suction recovery operation, interruption process means 1006 for effecting interruption at a predetermined time interval and under a predetermined condition, and suction recovery determining means 1004 for carrying out a process for determining the period of the next suction recovery operation.

Figure 20:
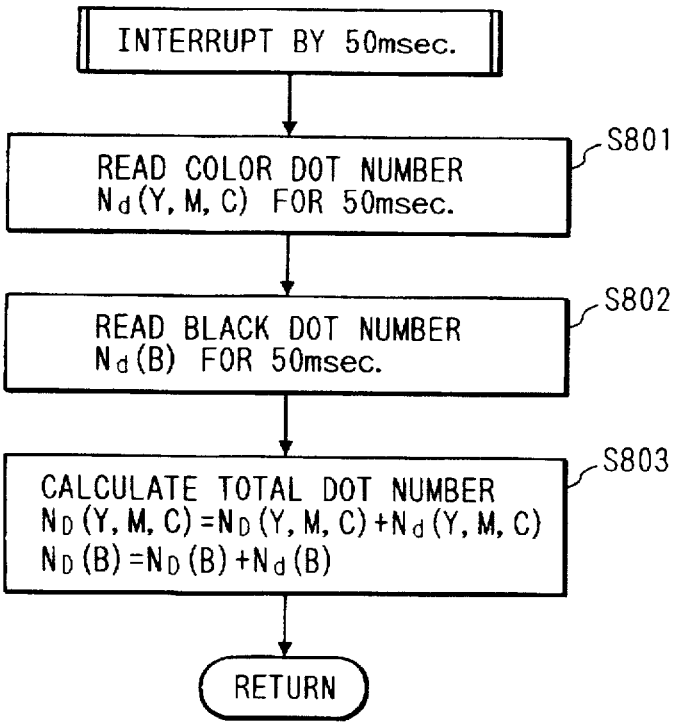
FIG. 20 is a flow chart showing the flow of 50 msec. interruption process in the suction recovery control means shown in FIG. 19.
Figure 21:
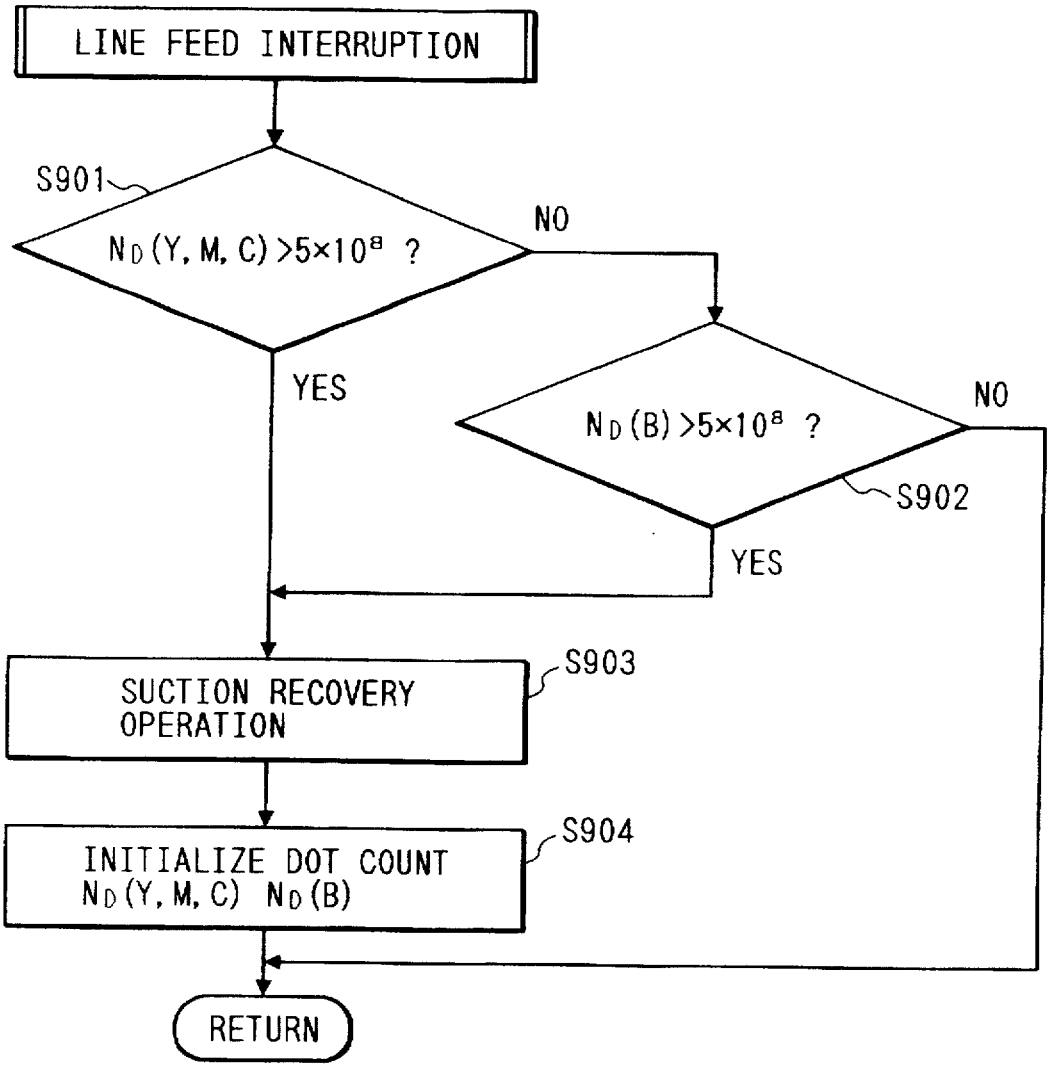
FIG. 21 is a flow chart showing the flow of a line feed interruption process in the suction recovery control means shown in FIG. 19.

As shown in FIGS. 20 and 21 which show the flow of the processing by this suction recovery control means, in the process of interruption by 50 msec. corresponding to FIG. 20, at a step S801, the numbers of dots $N_d$(Y, M, C) of the colors (yellow, magenta and cyan) counted for 50 msec. are read, and at a step S802, the number of dots $N_d$(B) of black is read. At a step S803, the numbers of dots $N_d$(Y, M, C, B) counted for 50 msec. are added to the hitherto counted total numbers of dots $N_D$(Y, M, C, B) to thereby provided new total numbers of dots $N_D$(Y, M, C, B).

On the other hand, in the process of interruption for each line feed shown in FIG. 21, at a step S901, whether the total numbers of dots $N_D$(Y, M, C) of the colors being counted at an interval of 50 msec. have exceeded a predetermined number of dots (in the present embodiment, $5\times10^8$) is judged, and if it is judged that these are equal to or less than the predetermined number of dots, shift is made to a step S902, where whether the total number of dots $N_D$(B) of black has exceeded a predetermined value (in the present embodiment, $15\times10^8$) is judged. If at this step S902, it is judged that the total number of dots $N_D$(B) of black is equal to or less than the predetermined value, nothing is done but this interruption process is terminated. Also, if at the step S901, it is judged that the total numbers of dots $N_D$(Y, M, C) of the colors have exceeded the predetermined number of dots and if at the step S902, it is judged that the total number of dots $N_D$(B) of black has exceeded the predetermined value, shift is made to a step S903, where the printing work is interrupted and the suction recovery operation is performed, and at a step S904, the total numbers of dots $N_D$(Y, M, C) of the colors are reset at 0 and the total number of dots $N_D$(B) of black is reset at 0, and this interruption process is terminated.

Thus, in the case of the ink jet head 18 capable of discharging a plurality of colors, by setting the predetermined number of dots of the ink liable to cause unsatisfactory print due to air bubbles to a small value, it becomes possible to obviate the unsatisfactory print due to air bubbles created in the common ink chambers 1c or near the discharge means during printing.

In the present embodiment, the predetermined number of dots for the black ink is about three times as great as that of each color ink, but it should desirably be a value best suited for the ink jet head 18 or the printing apparatus. Also, in order to make a simpler construction, it is effective that the counting of the number of dots of the black ink which scarcely causes unsatisfactory print due to air bubbles is not effected, but the numbers of dots of only the color inks are counted to thereby determine the period of the next suction recovery operation.

(Other Embodiments)

The present invention brings about an excellent effect, particularly among ink jet systems, in an ink jet head or an ink jet apparatus of a type which is provided with an electro-thermal conversion element for generating heat energy as energy available to effect ink discharge and in which the state change of ink is caused by said heat energy. According to such a type, higher density and higher minuteness of print can be achieved.

As regards the typical construction and principle of this, it is preferable to use the basic principle disclosed, for example, in U.S. Pat. No. 4,723,129 or U.S. Pat. No. 4,740,796. This system is applicable to both of the so-called on-demand type and the continuous type, and particularly in the case of the on-demand type, it is effective because at least one drive signal corresponding to print information and providing a rapid temperature rise exceeding nuclear boiling is applied to an electro-thermal conversion element disposed corresponding to a sheet or an ink path retaining ink therein, whereby the electro-thermal conversion element is caused to generate heat energy to thereby cause film boiling on the heat-acting surface of an ink jet head and as a result, an air bubble in the ink corresponding at one to one to this drive signal can be formed. By the growth and contraction of this air bubble, the ink is discharged through a discharge opening to thereby format least one droplet. If this drive signal is made into a pulse shape, the growth and contraction of the air bubble will take place on the spot and therefore the discharge of the ink particularly excellent in responsiveness can be achieved, and this is more preferable. As this drive signal of a pulse shape, one as described in U.S. Pat. No. 4,463,359 or U.S. Pat. No. 4,345,262 is suitable. More excellent printing could be accomplished if the conditions described in U.S. Pat. No. 4,313,124 covering an invention relating to the rate of temperature rise of said heat-acting surface are adopted.

As the construction of the ink jet head, besides the combined construction of the discharge port, the ink path and the electro-thermal conversion element as disclosed in each of the above-mentioned patents (a straight liquid flow path or a right-angled liquid flow path), a construction using U.S. Pat. No. 4,558,333 or U.S. Pat. No. 4,459,600 which discloses a construction in which a heat-acting portion is disposed in a bent area is also covered by the present invention. In addition, the present invention is also effective when it adopts a construction based on Japanese Laid-Open Patent Application No. 59-123670 which discloses a construction in which a slit common to a plurality of electro-thermal conversion elements is the discharge portion of the electro-thermal conversion elements, or Japanese Laid-Open Patent Application No. 59-138461 which discloses a construction in which an opening for absorbing the pressure wave of heat energy is made to correspond to a discharge portion. This is because whatever may be the form of the ink jet head, the present invention enables printing to be effected reliably and efficiently.

The present invention is also effective when use is made of an ink jet head fixed to an apparatus body, an ink jet head of the interchangeable chip type becoming capable of being electrically connected to the apparatus body or being supplied with ink from the apparatus body by being mounted on the apparatus body, or an ink jet head of the cartridge type having an ink tank provided integrally with the ink jet head itself.

According to the present invention, there can be provided an ink jet apparatus of high reliability in which the amount of air bubbles created can be estimated accurately and the frequency of suction can be minimized and the throughput of the printing apparatus is not reduced.

Also, design is made such that the timing at which unsatisfactory discharge occurs due to air bubbles is presumed from the ambient temperature of the ink jet head, the temperature of the vicinity of the ink path or the ink chamber and the frequency of ink discharge from the ink jet head and therefore, it becomes possible to perform the suction recovery operation immediately before unsatisfactory discharge occurs and thus, there can be provided an ink jet apparatus which is low in running cost.

What is claimed is:

1. An ink jet apparatus having an ink jet head for discharging ink from a discharge port, and recovery means for exhausting the ink from said discharge port and recovering a discharge state of the ink, said apparatus comprising:

temperature detecting means for detecting an ambient temperature of said ink jet head;

temperature obtaining means for obtaining the temperature of said ink jet head;

count means for counting a frequency of discharge of the ink from said ink jet head; and recovery control means, connected to said temperature detecting means, said temperature obtaining means and said count means, for determining a recovery operation of said recovery means in accordance with the difference between the temperature detected by said temperature detecting means and the temperature obtained bV said temperature obtaining means and a frequency of discharge obtained by said count means.

2. An ink jet apparatus according to claim 1, wherein said recovery control means corrects the frequency of discharge obtained by said count means, in accordance with the temperature detected by said temperature detecting means and the temperature obtained by said temperature obtaining means, and determines whether to effect performance of the recovery operation of said recovery means in conformity with the corrected frequency of discharge.

3. An ink jet apparatus according to claim 1, wherein said ink jet head has an ink path having one end thereof connected to said discharge port, and an ink chamber communicating with another end of said ink path and supplied with the ink through an ink supply path.

4. An ink jet apparatus according to claim 3, wherein said temperature obtaining means calculates a temperature of a vicinity in said ink path and said ink chamber.

5. An ink jet apparatus according to claim 1, wherein said ink jet head has discharge energy generating means for discharging the ink from said discharge port.

6. An ink jet apparatus according to claim 5, wherein said discharge energy generating means is a heat energy generating element for giving heat energy to the ink, and gives heat energy to the ink to thereby cause a state change by heat to the ink and effect the discharge of the ink by pressure caused by said state change.

7. An ink jet apparatus according to claim 1, wherein said temperature obtaining means obtains a temperature of said ink jet head using a sensor provided in said ink jet head.

8. An ink jet apparatus according to claim 1, wherein said temperature obtaining means obtains a temperature of said ink jet head by calculation.

9. An ink jet apparatus according to claim 1 wherein said recovery means exhausts ink from a discharge port of said ink jet head by sucking.

10. An ink jet apparatus having an ink jet head having a plurality of discharge ports for discharging ink therefrom, and recovery means for exhausting the ink from said discharge ports and recovering the discharge state of the ink, said apparatus comprising:

temperature detecting means for detecting the ambient temperature of said ink jet head;

temperature obtaining means for obtaining the temperature of said ink jet head;

count means for counting a frequency of discharge of the ink for each of a plurality of blocks of discharge ports, the plurality of discharge ports being divided into said plurality of blocks; and recovery control means, connected to said temperature detecting means, said temperature obtaining means and said count means, for determining the recovery operation of said recovery means in accordance with a difference between the temperature detected by said temperature detecting means and the temperature obtained by said temperature obtaining means and the frequency of discharge for each of said blocks obtained by said count means.

11. An ink jet apparatus according to claim 10, wherein said count means further comprises non-print time counting means for counting a time for which discharge has not been effected from the plurality of discharge ports corresponding to said plurality of blocks, and wherein said recovery control means corrects the frequency of discharge obtained by said count means, in accordance with the temperature detected by said temperature detecting means and the temperature obtained by said temperature obtaining means, and determines whether the corrected frequency of discharge reaches a predetermined value, or determines whether to effect performance of the recovery operation of said recovery means in conformity with whether the value obtained by correcting the non-print time obtained by said non-print time counting means, in accordance with the temperature detected by said temperature detecting means and the temperature obtained by said temperature obtaining means reaches a predetermined value.

12. An ink jet apparatus according to claim 10, wherein said ink jet head has a plurality of ink paths having one end of each thereof connected to each of said plurality of discharge ports, and an ink chamber communicating with another end of each of said plurality of ink paths and supplied with the ink through an ink supply path.

13. An ink jet apparatus according to claim 12, wherein said temperature obtaining means calculates a temperature of a vicinity of said ink paths or said ink chamber.

14. An ink jet apparatus according to claim 10, wherein said ink jet head has discharging energy generating means for discharging the ink from said discharge ports.

15. An ink jet apparatus according to claim 14, wherein said discharge energy generating means is a heat energy generating elements for giving heat energy to the ink, and gives heat energy to the ink to thereby cause a state change by heat to the ink and effect the discharge of the ink by pressure caused by said state change.

16. An ink jet apparatus according to claim 10, wherein said temperature obtaining means obtains a temperature of said ink jet head using a sensor provided in said ink jet head.

17. An ink jet apparatus according to claim 10, wherein said temperature obtaining means obtains a temperature of said ink jet head by calculation.

18. An ink jet apparatus according to claim 10, wherein said recovery means exhausts ink from a discharge port of said ink jet head by sucking.

19. An ink jet apparatus having an ink jet head for discharging ink from a discharge port by a drive pulse being applied to discharge means, and recovery means for exhausting the ink from said discharge port and recovering a discharge state of the ink, said apparatus comprising:

discharge amount control means for controlling an amount of ink discharged from said discharge port by modulation of said drive pulse;

temperature detecting means for detecting an ambient temperature of said ink jet head;

temperature obtaining means for obtaining the temperature of said ink jet head;

count means for counting a frequency of discharge of the ink from said ink jet head; and recovery control means, connected to said discharge amount control means, said temperature detecting means, said temperature obtaining means and said count means, for determining the recovery operation of said recovery means in accordance with a difference between the temperature detected by said temperature detecting means and the temperature obtained by said temperature obtaining means, the frequency of discharge obtained by said count means, and the amount of ink discharged under the control of said discharge amount control means.

20. An ink jet apparatus according to claim 19, wherein said recovery control means corrects the frequency of discharge obtained by said count means, in accordance with of the temperature obtained by said temperature detecting means, the temperature obtained by said temperature obtaining means, and the drive pulse applied to said discharge means, and determines whether to effect performance of the recovery operation of said recovery means in conformity with a corrected frequency of discharge.

21. An ink jet apparatus according to claim 19, wherein said ink jet head has an ink path having one end thereof connected to said discharge port, and an ink chamber communicating with another end of said ink path and supplied with the ink th rough an ink supply path.

22. An ink jet apparatus according to claim 21, wherein said temperature obtaining means calculates a temperature of a vicinity in said ink path and said ink chamber.

23. An ink jet apparatus according to claim 19, wherein said drive pulse comprises a first pulse which does not effect the discharge of the ink from said discharge port, and a second pulse applied at a time interval after application of said first pulse to thereby effect the discharge of the ink from said discharge port.

24. An ink jet apparatus according to claim 19, wherein said ink jet head has discharge energy generating means for discharging the ink from said discharge port.

25. An ink jet apparatus according to claim 24, wherein said discharge energy generating means is a heat energy generating element for giving heat energy to the ink, and gives heat energy to the ink to thereby cause a state change by heat to the ink and effect the discharge of the ink by pressure caused by said state change.

26. An ink jet apparatus according to claim 19, wherein said temperature obtaining means obtains a temperature of said ink jet head using a sensor provided in said ink jet head.

27. An ink jet apparatus according to claim 19, wherein said temperature obtaining means obtains a temperature of said ink jet head by calculation.

28. An ink jet apparatus according to claim 19, wherein said recovery means exhausts ink from a discharge port of said ink jet head by sucking.

29. A recovery controlling method in an ink jet apparatus having an ink jet head for discharging ink from a discharge port, and recovery means for exhausting the ink from said discharge port and recovering a discharge state of the ink, said method comprising:

a temperature detecting step of detecting the ambient temperature of said ink jet head;

a temperature obtaining step of obtaining the temperature of said ink jet head; and a counting step of counting a frequency of discharge of the ink from said ink jet head within a first predetermined times, said temperature detecting step, said temperature obtaining step and said counting step each being carried out for each predetermined unit of time; and a determining step for a recovery operation of said recovery means in accordance with the difference between the temperature detected in said temperature detecting step and the temperature obtained in said temperature obtaining step at predetermined timing of a time interval longer than said predetermined unit time.

30. A recovery controlling method according to claim 29, wherein said determining step further comprises correcting the frequency of discharge obtained by said counting step in accordance with the temperature detected in said temperature detecting step and the temperature obtained by said temperature obtaining step, and determining whether to perform the recovery operation of said recovery means in conformity with a corrected frequency of discharge.

31. A recovery controlling method according to claim 29, wherein said ink jet head has an ink path having one end thereof connected to said discharge port, and an ink chamber communicating with another end of said ink path and supplied with the ink through an ink supply path.

32. A recovery controlling method according to claim 31, wherein said temperature obtaining step further comprises calculating a temperature in a vicinity of said ink path and said ink chamber.

33. A recovery controlling method according to claim 29, wherein said ink jet head has discharge energy generating means for discharging the ink from said discharge port.

34. A recovery controlling method according to claim 33, wherein said discharge energy generating means is a heat energy generating element for giving heat energy to the ink, and gives heat energy to the ink to thereby cause a state change by heat to the ink and effect the discharge of the ink by pressure caused by said state change.

35. A recovery controlling method according to claim 29, wherein said temperature obtaining step further comprises obtaining a temperature of said ink jet head using a sensor provided in said ink jet head.

36. A recovery controlling method according to claim 29, wherein said temperature obtaining step further comprises obtaining a temperature of said ink jet head by calculation.

37. A recovery controlling method according to claim 29, wherein said recovery means exhausts ink from a discharge port of said ink jet head by sucking.

* * * * *

UNITED STATES PATENT AND TRADEMARK OFFICE

CERTIFICATE OF CORRECTION

PATENT NO. : 5,781,204

DATED : July 14, 1998

INVENTOR(S) : DAIGORO KANEMATSU ET AL.

It is certified that error appears in the above-identified patent and that said Letters Patent is hereby corrected as shown below:

IN THE DRAWINGS

Figure 16, "PRESUMMING" should read --PRESUMPTION--.

COLUMN 1

Line 58, "that as" should read --as that--.

COLUMN 4

Line 50, "n" should read --shown--.

COLUMN 6

Line 49, "if" should read --it--.

COLUMN 8

Line 58, "element" should read --elements--.

COLUMN 10

Line 64, "paths if" should read --paths 1f--.

COLUMN 13

Line 12, "timing-of" should read --timing of--.

UNITED STATES PATENT AND TRADEMARK OFFICE

CERTIFICATE OF CORRECTION

PATENT NO. : 5,781,204

DATED : July 14,1998

INVENTOR(S) : Daigoro Kanematsu, et al.

It is certified that error appears in the above-identified patent and that said Letters Patent is hereby corrected as shown below:

COLUMN 14

Line 5, "a" should read --α--;
Line 66, "exceed" should read --exceeded--.

COLUMN 15

Line 40, "provided" should read --provide--.

COLUMN 17

Line 42, "bV" should read --by--;
Line 57, "of" should read --in--; and
Line 58, "in" should read --of--.

COLUMN 18

Line 6, "claim 1" should read --claim 1,--.

UNITED STATES PATENT AND TRADEMARK OFFICE

CERTIFICATE OF CORRECTION

PATENT NO. : 5,781,204

DATED : July 14, 1998

INVENTOR(S) : DAIGORO KANEMATSU ET AL.

It is certified that error appears in the above-identified patent and that said Letters Patent is hereby corrected as shown below:

COLUMN 19

Line 34, "of" should be deleted;
Line 45, "th rough" should read --through--; and
Line 47, "of: should read --in-- and "in" should read --of--.

COLUMN 20

Line 17, "times," should read --time,--;
Line 22, "for" should read --for determining--; and
Line 23, "the" should read --a--.

Signed and Sealed this

Twenty-fifth Day of May, 1999

*Attest:*

Q. TODD DICKINSON

*Attesting Officer*

*Acting Commissioner of Patents and Trademarks*